US008141186B2

(12) United States Patent
Burns et al.

(10) Patent No.: US 8,141,186 B2
(45) Date of Patent: Mar. 27, 2012

(54) MESH ARRANGEMENT FOR BASSINET ASSEMBLY

(75) Inventors: Stephen R. Burns, Cumming, GA (US); Peter D. Jackson, Alpharetta, GA (US); Mark Mendes, Loganville, GA (US)

(73) Assignee: Kids II, Inc., Atlanta, GA (US)

( * ) Notice: Subject to any disclaimer, the term of this patent is extended or adjusted under 35 U.S.C. 154(b) by 249 days.

(21) Appl. No.: 12/236,709

(22) Filed: Sep. 24, 2008

(65) Prior Publication Data

US 2009/0077741 A1 Mar. 26, 2009

Related U.S. Application Data

(60) Provisional application No. 60/995,417, filed on Sep. 25, 2007.

(51) Int. Cl.
*A47C 7/00* (2006.01)

(52) U.S. Cl. ..... 5/98.1; 5/93.1

(58) Field of Classification Search ..... 5/93.1–100, 5/112–114, 946; 160/377, 378, DIG. 7; D6/331, D6/390, 391
See application file for complete search history.

(56) References Cited

U.S. PATENT DOCUMENTS

| | | | | |
|---|---|---|---|---|
| 2,397,697 | A | 4/1946 | Shaw | |
| 2,548,769 | A | 4/1951 | Burgin | |
| 3,018,493 | A | 1/1962 | Wittbrodt | |
| 3,021,553 | A | 2/1962 | Schiemer | |
| 3,092,847 | A * | 6/1963 | De Puy | 5/99.1 |
| 3,203,011 | A * | 8/1965 | Faludi | 5/94 |
| 3,720,965 | A | 3/1973 | Wright | |
| 4,031,724 | A | 6/1977 | Atkinson | |
| 4,070,716 | A | 1/1978 | Satt et al. | |
| 4,350,375 | A | 9/1982 | Bako | |
| 4,366,684 | A | 1/1983 | Bako et al. | |
| 4,376,318 | A | 3/1983 | Cirillo | |
| 4,483,026 | A | 11/1984 | Kassai | |
| 4,538,309 | A * | 9/1985 | Gunter | 5/99.1 |
| 4,611,945 | A | 9/1986 | Diego | |
| 4,614,454 | A | 9/1986 | Kassai | |
| 4,710,049 | A | 12/1987 | Chang | |

(Continued)

FOREIGN PATENT DOCUMENTS

EP 1653829 3/2005

(Continued)

OTHER PUBLICATIONS

United Kingdom Search report of corresponding Great Britain Application No. 0817626.5; date of Search Report Jan. 16, 2009.

(Continued)

*Primary Examiner* — Robert G Santos
*Assistant Examiner* — Nicholas Polito
(74) *Attorney, Agent, or Firm* — Alston & Bird LLP

(57) ABSTRACT

According to various embodiments, a bassinet assembly includes a floor and one or more side walls that extend upwardly from a perimeter of the floor and surround the floor. Each side wall has an upper perimeter and includes a mesh portion that extends substantially the height of the side wall from the upper perimeter to the floor. Each side wall also includes a substantially solid wall portion that extends from the upper perimeter to an intermediate portion disposed between the upper perimeter and the floor. At least a portion of the side wall between the intermediate portion and the floor of the bassinet assembly is mesh to allow a child lying therein to breathe.

9 Claims, 20 Drawing Sheets

U.S. PATENT DOCUMENTS 4,712,733 A 12/1987 Davis
4,715,075 A 12/1987 Shamie
4,739,527 A 4/1988 Kohus et al.
4,811,437 A 3/1989 Dillner et al.
4,837,875 A 6/1989 Shamie et al.
4,856,306 A 8/1989 Scelba et al.
D304,523 S 11/1989 Dillner et al.
4,891,852 A 1/1990 Lopez, Jr.
4,899,496 A 2/1990 Chew, II
4,921,369 A 5/1990 Chew, II et al.
4,934,025 A 6/1990 Mariol
4,967,432 A 11/1990 Kujawski et al.
4,985,948 A 1/1991 Mariol
5,013,086 A 5/1991 Benzur
D320,316 S 10/1991 Arnold
5,067,207 A 11/1991 Semons
5,163,191 A 11/1992 Chan
5,197,154 A 3/1993 Shamie
5,211,498 A 5/1993 Huang
D336,234 S 6/1993 Burgin et al.
5,228,154 A 7/1993 Brevi et al.
5,239,656 A 8/1993 Kawano
5,239,714 A 8/1993 Huang
5,241,716 A 9/1993 Kohus
5,243,718 A 9/1993 Shamie
5,271,104 A 12/1993 LaTora
5,279,006 A 1/1994 Teng
5,339,470 A 8/1994 Shamie
D351,756 S 10/1994 Miller et al.
5,353,451 A 10/1994 Hsiung
5,358,220 A 10/1994 Yu-Kuang
5,363,521 A 11/1994 Garland et al.
5,367,725 A 11/1994 Tsai
5,375,294 A 12/1994 Garrett
5,377,368 A 1/1995 Cheng
5,381,570 A 1/1995 Cheng
5,394,574 A 3/1995 Chuang
5,446,931 A 9/1995 Wei
5,452,930 A 9/1995 Morgan
5,454,124 A 10/1995 Huang
5,457,828 A 10/1995 Huang
5,465,439 A 11/1995 Chien
5,474,404 A 12/1995 Chien
5,483,710 A 1/1996 Chan
5,485,655 A 1/1996 Wang
5,497,517 A 3/1996 Wang
5,504,951 A 4/1996 Yeh
5,513,399 A 5/1996 Weng
5,526,542 A 6/1996 Huang
5,530,977 A 7/1996 Wang
5,533,215 A 7/1996 Malofsky et al.
5,539,957 A 7/1996 Schmidt
5,542,134 A 8/1996 Wang
5,542,151 A 8/1996 Stranski et al.
5,544,372 A 8/1996 Garland et al.
5,544,864 A 8/1996 Gabriel-Lacki et al.
5,553,336 A 9/1996 Mariol
5,557,954 A 9/1996 Ling
5,560,055 A 10/1996 Ziegler
5,561,874 A 10/1996 Malofsky et al.
5,581,827 A 12/1996 Fong et al.
5,611,634 A 3/1997 Wang
5,615,427 A 4/1997 Huang
5,617,592 A 4/1997 Cheng
5,636,853 A 6/1997 Huang
5,643,189 A 7/1997 Masini
5,664,267 A 9/1997 Cheng
5,694,655 A 12/1997 Shepler et al.
5,697,111 A 12/1997 Dillner et al.
5,699,997 A 12/1997 Huang
D388,640 S 1/1998 Burgin
D388,973 S 1/1998 Levin
5,711,040 A 1/1998 Huang
5,727,265 A 3/1998 Ziegler et al.
5,730,542 A 3/1998 Cheng
5,745,954 A 5/1998 Shogan et al.
5,752,283 A 5/1998 Arens
5,761,754 A 6/1998 Cheng
5,761,755 A 6/1998 Huang
5,778,465 A 7/1998 Myers
5,781,944 A 7/1998 Huang
5,791,804 A 8/1998 Cheng
5,803,650 A 9/1998 Wu
5,819,342 A 10/1998 Williams
5,826,285 A 10/1998 Mariol et al.
5,845,349 A 12/1998 Tharalson et al.
5,845,666 A 12/1998 Messner
5,857,229 A 1/1999 Magnani, Jr.
5,857,232 A 1/1999 Mahdavi
5,861,579 A 1/1999 Bickersteth et al.
5,862,548 A 1/1999 Gerhart
5,867,850 A * 2/1999 Mariol ..... 5/93.2
5,882,079 A 3/1999 Yang
D407,915 S 4/1999 Mariol et al.
5,890,263 A 4/1999 Wu
5,904,344 A 5/1999 Pope et al.
5,906,013 A 5/1999 Wang
5,906,014 A 5/1999 Zhuang
5,911,653 A 6/1999 Cheng
5,918,329 A 7/1999 Huang
5,947,552 A 9/1999 Wilkins et al.
5,964,545 A 10/1999 Cheng
5,970,540 A 10/1999 Cheng
5,978,987 A 11/1999 Wang
5,991,944 A 11/1999 Yang
6,018,846 A 2/2000 Huang
6,026,524 A 2/2000 Barger
6,058,528 A 5/2000 Yang
6,067,676 A 5/2000 Carnahan et al.
6,076,205 A 6/2000 Yang
6,079,063 A 6/2000 Cheng
6,131,218 A * 10/2000 Wang ..... 5/93.1
6,148,456 A 11/2000 Tharalson et al.
6,158,067 A 12/2000 Cheng
6,170,099 B1 1/2001 Cheng
6,192,535 B1 2/2001 Warner, Jr. et al.
6,202,455 B1 3/2001 Su
D442,811 S 5/2001 Delaplaine et al.
6,223,366 B1 5/2001 Cheng
6,233,759 B1 5/2001 Warner, Jr. et al.
6,250,837 B1 6/2001 Mariol et al.
6,256,814 B1 7/2001 Drobinski
6,257,659 B1 7/2001 Wilkins et al.
6,263,525 B1 7/2001 Liu
D448,218 S 9/2001 Celestina-Krevh
6,305,037 B1 10/2001 Cheng
6,308,352 B1 10/2001 Cheng
6,317,907 B1 11/2001 Wang
6,336,234 B1 1/2002 Kuo
6,339,856 B1 1/2002 Chen et al.
6,341,394 B1 1/2002 Wang
6,343,390 B1 2/2002 Yang et al.
6,349,434 B1 2/2002 Zhuang
6,363,550 B1 4/2002 Wang
6,364,563 B1 4/2002 Cheng
6,385,800 B1 5/2002 Chen et al.
6,390,555 B2 5/2002 Wilkins et al.
6,418,575 B1 7/2002 Cheng
6,421,850 B1 7/2002 Welsh, Jr.
6,421,857 B2 7/2002 Whatman et al.
6,430,762 B1 8/2002 Cheng
6,434,767 B1 8/2002 Welsh, Jr.
6,467,108 B1 10/2002 Wang
6,470,515 B1 10/2002 Hsia
6,470,516 B2 10/2002 Lopez, Jr.
6,473,919 B1 11/2002 Wang
D467,758 S 12/2002 Hartenstine et al.
6,510,568 B1 1/2003 Drobinski et al.
6,510,569 B1 1/2003 Hu
6,510,570 B2 1/2003 Hartenstine et al.
6,526,608 B1 3/2003 Hsia
6,536,084 B2 3/2003 Davis
6,539,563 B1 4/2003 Hsia
6,543,070 B2 4/2003 Longenecker et al.
6,568,004 B1 5/2003 Sun
6,571,408 B1 6/2003 Wang
6,578,212 B2 6/2003 Roudebush

| | | | |
|---|---|---|---|
| 6,588,033 | B1 | 7/2003 | Welsh, Jr. et al. |
| 6,615,424 | B1 | 9/2003 | Cheng |
| 6,634,038 | B2 | 10/2003 | Hsia |
| 6,634,039 | B1 | 10/2003 | Cheng |
| 6,647,108 | B1 | 11/2003 | Wurster et al. |
| 6,665,895 | B1 | 12/2003 | St. Pierre et al. |
| 6,671,902 | B2 | 1/2004 | Cheng |
| 6,675,413 | B2 | 1/2004 | Hsia |
| 6,687,928 | B1 | 2/2004 | Wilson |
| 6,698,042 | B2 | 3/2004 | Cheng |
| 6,701,547 | B2 | 3/2004 | Hsia |
| 6,704,949 | B2 | 3/2004 | Waldman et al. |
| 6,711,760 | B1 | 3/2004 | Yang |
| 6,721,970 | B1 | 4/2004 | Cheng |
| 6,721,971 | B1 | 4/2004 | Cheng |
| 6,725,475 | B1 | 4/2004 | Chen |
| 6,728,980 | B1 | 5/2004 | Chen |
| 6,735,796 | B2 | 5/2004 | Warner, Jr. et al. |
| D493,974 | S | 8/2004 | Chiu |
| D493,985 | S | 8/2004 | Chen |
| D494,393 | S | 8/2004 | Chen |
| D498,089 | S | 11/2004 | Myers |
| D500,213 | S | 12/2004 | DeHart et al. |
| 6,851,135 | B1 | 2/2005 | Chen |
| 6,859,957 | B1 | 3/2005 | Chen |
| 6,865,756 | B2 | 3/2005 | Clapper et al. |
| 6,874,177 | B2 | 4/2005 | Hsia |
| 6,877,173 | B2 | 4/2005 | Tharalson et al. |
| 6,895,611 | B2 | 5/2005 | Tharalson et al. |
| 6,907,626 | B1 | 6/2005 | Welsh, Jr. et al. |
| 6,915,536 | B2 | 7/2005 | Chen |
| 6,915,545 | B2 | 7/2005 | Chen |
| 6,934,981 | B2 | 8/2005 | Waldman et al. |
| 6,939,194 | B2 | 9/2005 | Bapst et al. |
| 6,948,197 | B1 | 9/2005 | Chen |
| 6,952,849 | B2 | 10/2005 | Pacella |
| 6,954,949 | B1 | 10/2005 | Chen |
| 6,959,462 | B2 | 11/2005 | Chen |
| 6,961,968 | B2 | 11/2005 | Clapper et al. |
| 6,964,071 | B1 | 11/2005 | Lahmann |
| 6,966,082 | B2 | 11/2005 | Bloemer et al. |
| 6,970,626 | B2 | 11/2005 | Birnbach |
| 7,003,821 | B2 | 2/2006 | DeHart et al. |
| 7,013,505 | B2 | 3/2006 | Martin |
| D518,320 | S | 4/2006 | DeHart et al. |
| 7,036,161 | B2 | 5/2006 | Harrison et al. |
| 7,037,170 | B2 | 5/2006 | Pacella et al. |
| 7,043,779 | B2 | 5/2006 | Mendenhall et al. |
| 7,043,780 | B1 | 5/2006 | Cheng |
| RE39,136 | E | 6/2006 | Tharalson et al. |
| 7,055,191 | B1 | 6/2006 | Chen |
| D525,318 | S | 7/2006 | Campbell et al. |
| D526,133 | S | 8/2006 | Song |
| 7,096,874 | B2 | 8/2006 | Forshpan |
| 7,108,443 | B2 | 9/2006 | Chen |
| D534,381 | S | 1/2007 | Troutman et al. |
| D534,749 | S | 1/2007 | Wang |
| D537,277 | S | 2/2007 | Chen |
| D537,285 | S | 2/2007 | Chen |
| 7,228,575 | B2 | 6/2007 | Chen |
| 7,263,729 | B2 | 9/2007 | Paesang et al. |
| RE40,754 | E | 6/2009 | Morton |
| 2002/0092094 | A1 | 7/2002 | Welsh, Jr. |
| 2003/0046761 | A1 | 3/2003 | Hsia |
| 2003/0070229 | A1 | 4/2003 | Hsia |
| 2003/0106149 | A1 | 6/2003 | Hsia |
| 2004/0060110 | A1 | 4/2004 | Wajnsztejn |
| 2004/0133977 | A1 | 7/2004 | Vidal |
| 2005/0005353 | A1 | 1/2005 | Waldman et al. |
| 2005/0011004 | A1 | 1/2005 | Favorito (nee Wilkins) et al. |
| 2005/0034232 | A1 | 2/2005 | Martin |
| 2005/0045221 | A1 | 3/2005 | Forshpan |
| 2005/0144716 | A1 | 7/2005 | Chen |
| 2005/0144717 | A1 | 7/2005 | Chen |
| 2005/0210580 | A1 | 9/2005 | Clapper |
| 2005/0210581 | A1 | 9/2005 | Clapper et al. |
| 2005/0229308 | A1 | 10/2005 | Chen |
| 2005/0241064 | A1 | 11/2005 | Lopes et al. |
| 2005/0246835 | A1 | 11/2005 | Tu |
| 2005/0257319 | A1 | 11/2005 | Ikeda et al. |
| 2005/0262628 | A1 | 12/2005 | Tharalson et al. |
| 2006/0000019 | A1 | 1/2006 | Martin |
| 2006/0021134 | A1 | 2/2006 | Chen |
| 2006/0052172 | A1 | 3/2006 | Stephen et al. |
| 2006/0080776 | A1 | 4/2006 | Clapper et al. |
| 2006/0130237 | A1 | 6/2006 | Clapper et al. |
| 2006/0174406 | A1 | 8/2006 | Yang |
| 2006/0207023 | A1 | 9/2006 | Dehart et al. |
| 2006/0218725 | A1 | 10/2006 | Carpenter et al. |
| 2006/0225204 | A1 | 10/2006 | Bretschger et al. |
| 2006/0225205 | A1 | 10/2006 | Troutman |
| 2007/0017025 | A1 | 1/2007 | Myer |
| 2007/0061961 | A1 | 3/2007 | Shamie |
| 2007/0157393 | A1 | 7/2007 | Gerlach |
| 2007/0186344 | A1 | 8/2007 | Cheng |
| 2007/0204400 | A1 | 9/2007 | Yang |
| 2008/0029103 | A1 | 2/2008 | Regev et al. |
| 2008/0229496 | A1 | 9/2008 | Wang |
| 2009/0025148 | A1 | 1/2009 | Cheng et al. |

FOREIGN PATENT DOCUMENTS

| | | | |
|---|---|---|---|
| EP | 2 022 374 | A1 | 2/2009 |
| FR | 2 896 969 | A1 | 8/2007 |
| GB | 2 375 299 | A | 11/2002 |
| WO | WO 93/09735 | | 5/1993 |
| WO | WO 03/079860 | | 10/2003 |

OTHER PUBLICATIONS

United Kingdom Search Report of corresponding Great Britain Application No. 0817627.3; date of Search Report Jan. 13, 2009.

United Kingdom Search Report of corresponding Great Britain Application No. 0817628.1; date of Search Report Dec. 17, 2008.

United Kingdom Search Report of corresponding Great Britain Application No. 0817629.9; date of Search Report Nov. 18, 2008.

United Kingdom Search Report of corresponding Great Britain Application No. 0817629.9; date of Search Report Jul. 20, 2009.

United Kingdom Search Report of corresponding Great Britain Application No. 0817628.1; date of Search Report Jul. 20, 2009.

Office Action mailed Oct. 16, 2009 of co-pending U.S. Appl. No. 12/236,929.

Notice of Allowance mailed Apr. 23, 2010 of co-pending U.S. Appl. No. 12/236,929.

Office Action mailed May 3, 2010 of co-pending U.S. Appl. No. 12/236,767.

Office Action mailed Apr. 14, 2010 of co-pending U.S. Appl. No. 12/236,973.

Office Action dated Jul. 25, 2011 for Application No. GB0817626.5, 1 page.

Office Action dated Jul. 25, 2011 for Application No. GB0817628.1, 2 pages.

Office Action dated Jul. 25, 2011 for Application No. GB0817629.9, 2 pages.

Office Action dated Jul. 25, 2011 for Application No. GB0817627.3, 2 pages.

Office Action mailed Jun. 9, 2010 of co-pending U.S. Appl. No. 12/236,743.

UK Office Action dated Nov. 7, 2011 for GB Application No. 0817629.9, 1 page.

UK Office Action dated Nov. 10, 2011 for GB Application No. 1116891.1, 4 pages.

Office Action dated Oct. 5, 2011 for U.S. Appl. No. 12/236,743, 15 pages.

* cited by examiner

MESH ARRANGEMENT FOR BASSINET ASSEMBLY

CROSS REFERENCE TO RELATED APPLICATIONS

This application claims priority to U.S. Provisional Application Ser. No. 60/995,417, filed Sep. 25, 2007 and entitled "PLAY YARD," which is herein incorporated by reference in its entirety. In addition, this application incorporates by reference in their entirety the following co-pending applications filed concurrently with this application: U.S. application Ser. No. 12/236,929, filed Sep. 24, 2008 and entitled "PLAY YARD AND BASSINET ASSEMBLY"; U.S. application Ser. No. 12/237,001, filed Sep. 24, 2008 and entitled ZIPPER PULL TAB LOCK; U.S. application Ser. No. 12/236,743, filed Sep. 24, 2008 and entitled "REDUNDANT SUPPORT FEATURE FOR BASSINET ASSEMBLY AND PLAY YARD COMBINATION"; U.S. application Ser. No. 12/236,767, filed Sep. 24, 2008 and entitled "COLLAPSIBLE PLAY YARD AND BASSINET ASSEMBLY COMBINATION"; and U.S. application Ser. No. 12/236,973, filed Sep. 24, 2008 and entitled "SUPPORT FOR AN INCLINABLE BASSINET ASSEMBLY".

BACKGROUND OF THE INVENTION

A play yard, which is sometimes referred to as a play pen, is a containment device that typically includes a rigid enclosure having four side walls, a floor, and an upper opening through which a child may be moved in and out of the play yard. The rigid enclosure includes upper and lower horizontal frame members that are joined by vertical frame members, and a solid fabric material is positioned over the frame members. The side walls typically include a mesh portion that extends between the solid fabric material covering the frame members to allow for visibility of the child within the play yard and provide adequate air flow to the child. In addition, the frame members may be collapsible with respect to each other to allow for easier portability and storage of the play yard.

Many play yards further include a bassinet that can be hung from the upper horizontal frame members of the play yard. In particular, the bassinets, such as the bassinet for attachment in a child's play yard described in U.S. Pat. No. 5,778,465, typically include four side walls, a floor, and a plurality of U-shaped plastic hooks that extend from the upper perimeter of two or more of the four side walls. The plastic hooks are configured for engaging the upper horizontal frame members of the play yard such that the floor of the bassinet is suspended above the floor of the play yard. In some products, the bassinet includes a fabric loop along the upper perimeter of two or more of the four side walls, and each fabric loop receives a metal rod. The ends of each metal rod extend outside of the fabric loop and are received into molded U-shaped hooks disposed adjacent the upper horizontal frame members. Some other products, such as the bassinet for suspension in a play yard play described in U.S. Pat. No. 6,434,767, include a combination of the U-shaped plastic hooks and the fabric loop and metal rod engagement means to support the bassinet floor above the play yard floor.

In addition, many play yards are collapsed by pulling up on a strap or handle disposed on the floor of the play yard and attached to the horizontal frame members and then, by releasing hinges along the upper horizontal frame members. By pulling up on the strap or handle, the horizontal frame members and the vertical frame members are drawn toward a central vertical axis extending through the floor of the play yard. However, this strap or handle is inaccessible when the bassinet is installed within the play yard, resulting in the additional, often difficult step of having to remove the bassinet to access the strap or handle when the play yard is to be transported or stored.

BRIEF SUMMARY OF VARIOUS EMBODIMENTS OF THE INVENTION

According to various embodiments, a bassinet assembly is provided that includes a floor and one or more side walls that extend upwardly from a perimeter of the floor and surround the floor. The side walls have an upper perimeter and include a mesh portion that extends substantially the height of each side wall from the upper perimeter of each side wall to the floor. The side walls also include a solid wall portion that extends from the upper perimeter of each side wall to an intermediate portion of each side wall. The intermediate portion is disposed between the upper perimeter of each side wall and the floor, and at least a portion of the side wall between the intermediate portion and the floor of the bassinet assembly is mesh. According to various embodiments, a child laying in the bassinet assembly can breathe through the mesh portion. In a particular embodiment, the portion of each side wall between the intermediate portion and the floor of the bassinet assembly aligns with a mesh portion of one or more side walls of a play yard when the bassinet assembly is secured within the play yard.

In another embodiment, a play yard is provided that includes a floor and one or more side walls that extend upwardly from a perimeter of the floor and surround the floor. The side walls have an upper perimeter and include a mesh portion that extends substantially the height of each side wall from the upper perimeter of each side wall to the floor. The side walls also include a solid fabric portion that extends from the upper perimeter of each side wall to an intermediate portion of each side wall. The intermediate portion is disposed between the upper perimeter of each side wall and the floor, and at least a portion of the side wall between the intermediate portion and the floor of the play yard is mesh. According to various embodiments, a child lying in the play yard can breathe through the mesh portion. In a particular embodiment, the portion of each side wall between the intermediate portion and the floor of the play yard aligns with a mesh portion of one or more side walls of a bassinet assembly when the bassinet assembly is secured within the play yard.

BRIEF DESCRIPTION OF THE DRAWINGS

Figure 1:
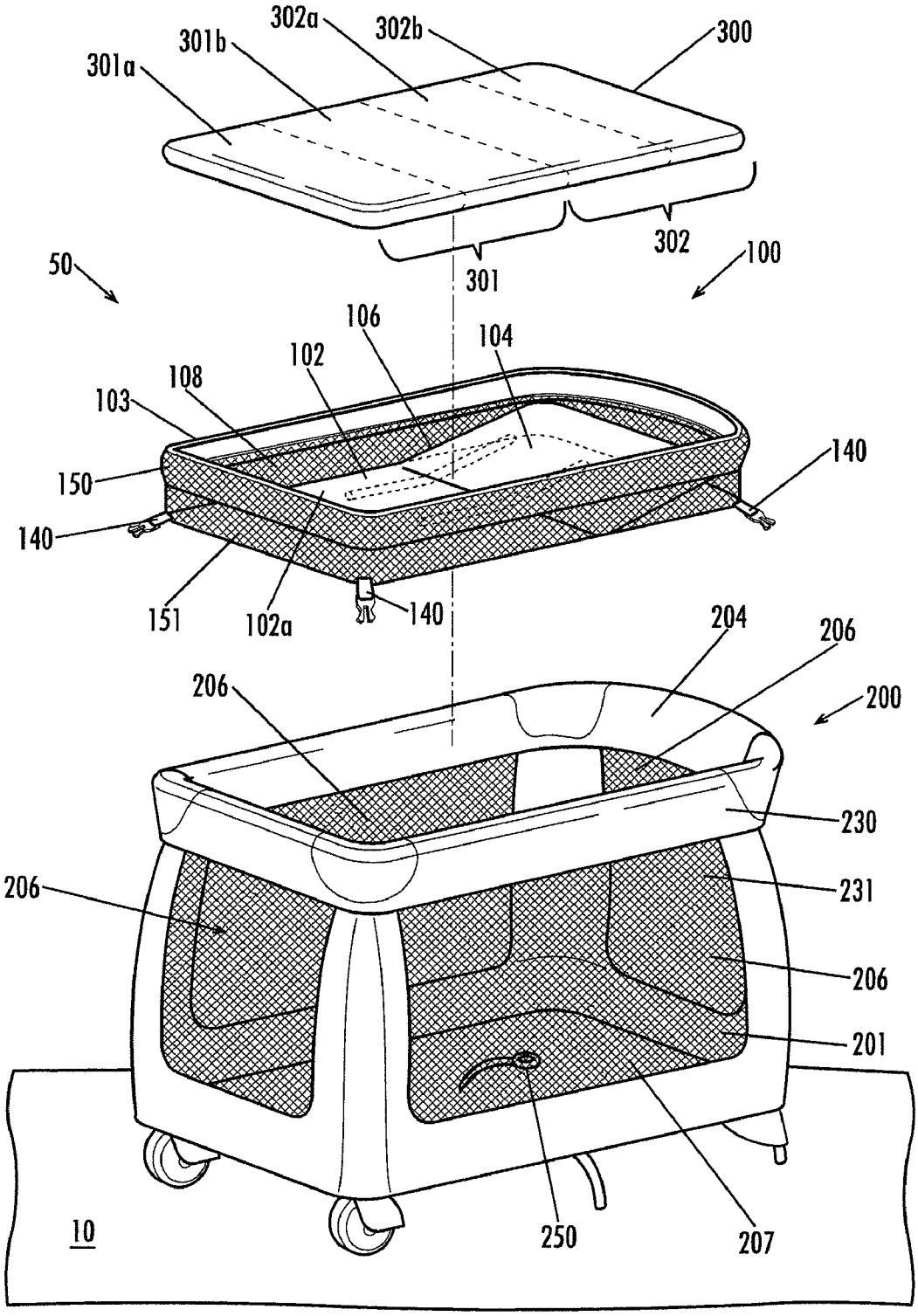

Having thus described various embodiments of the invention in general terms, reference will now be made to the accompanying drawings, which are not necessarily drawn to scale, and wherein:

FIG. 1 illustrates an exploded upper perspective view of a play yard and bassinet assembly combination according to various embodiments of the invention.

Figure 2:
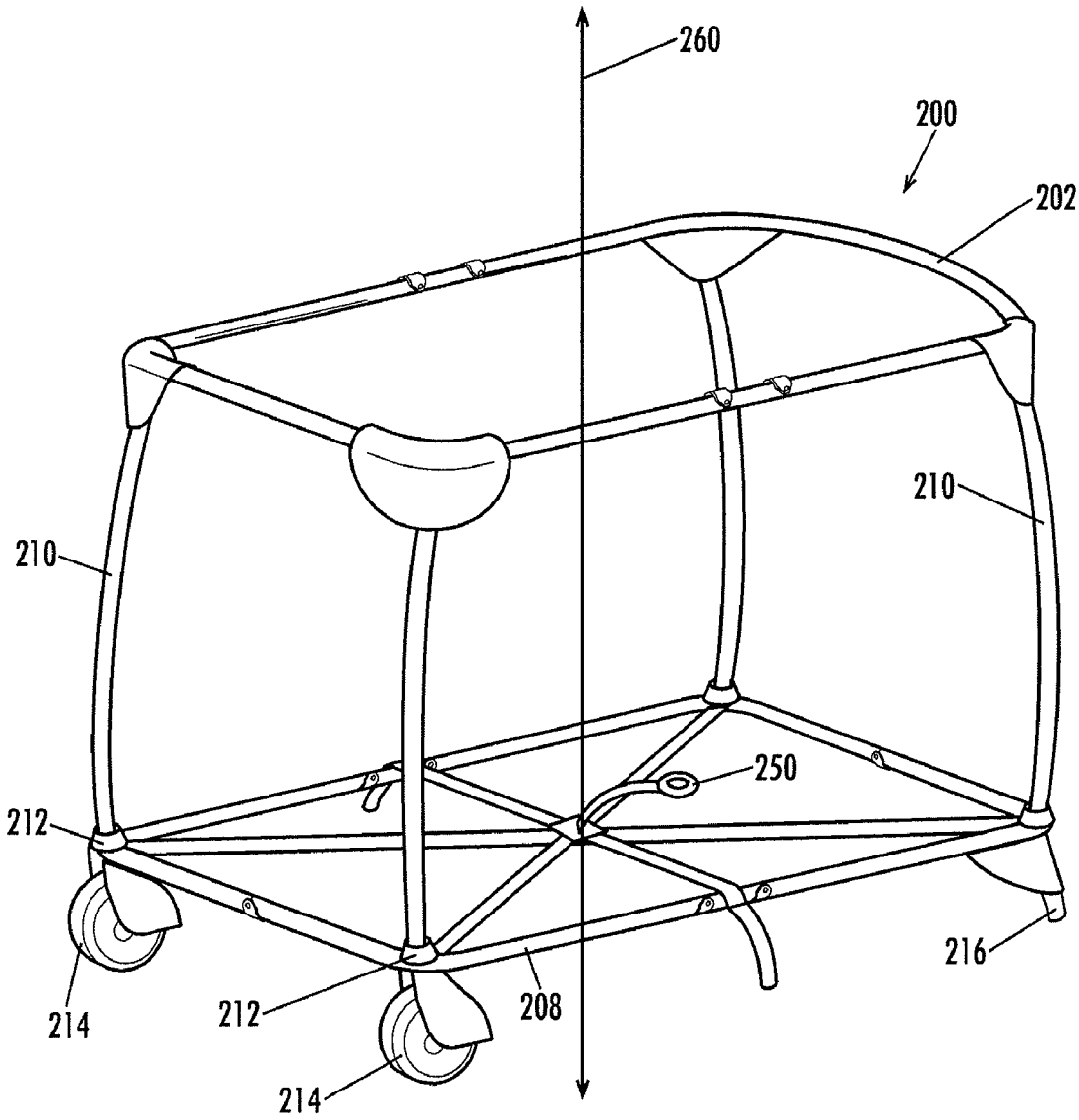

FIG. 2 illustrates an upper perspective view of frame members of a play yard according to various embodiments of the invention.

Figure 3:
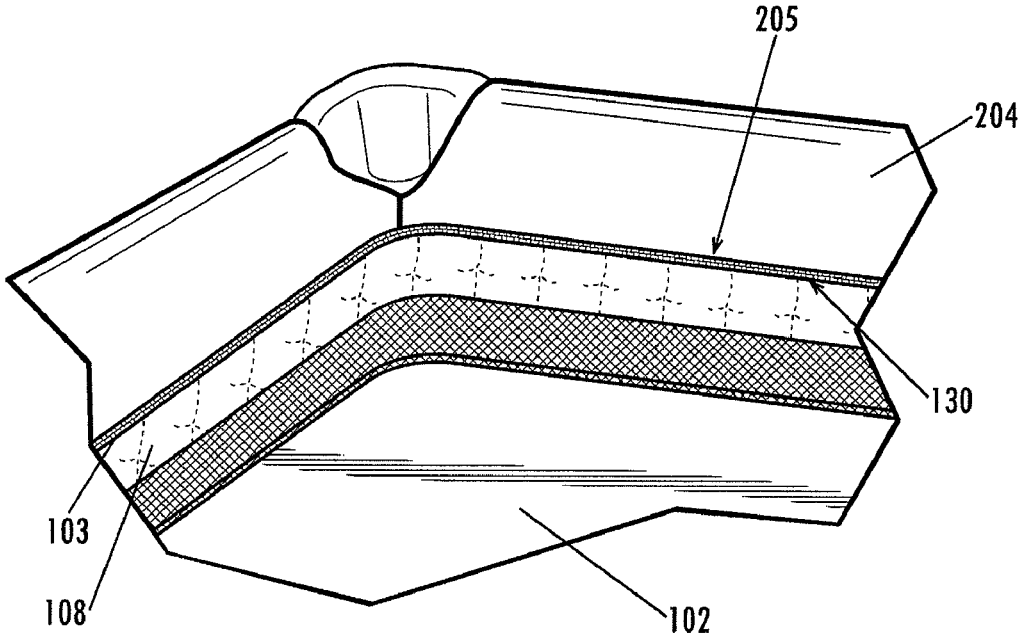

FIG. 3 illustrates a partial upper perspective view of the play yard and bassinet assembly combination shown in FIG. 1.

Figure 4:
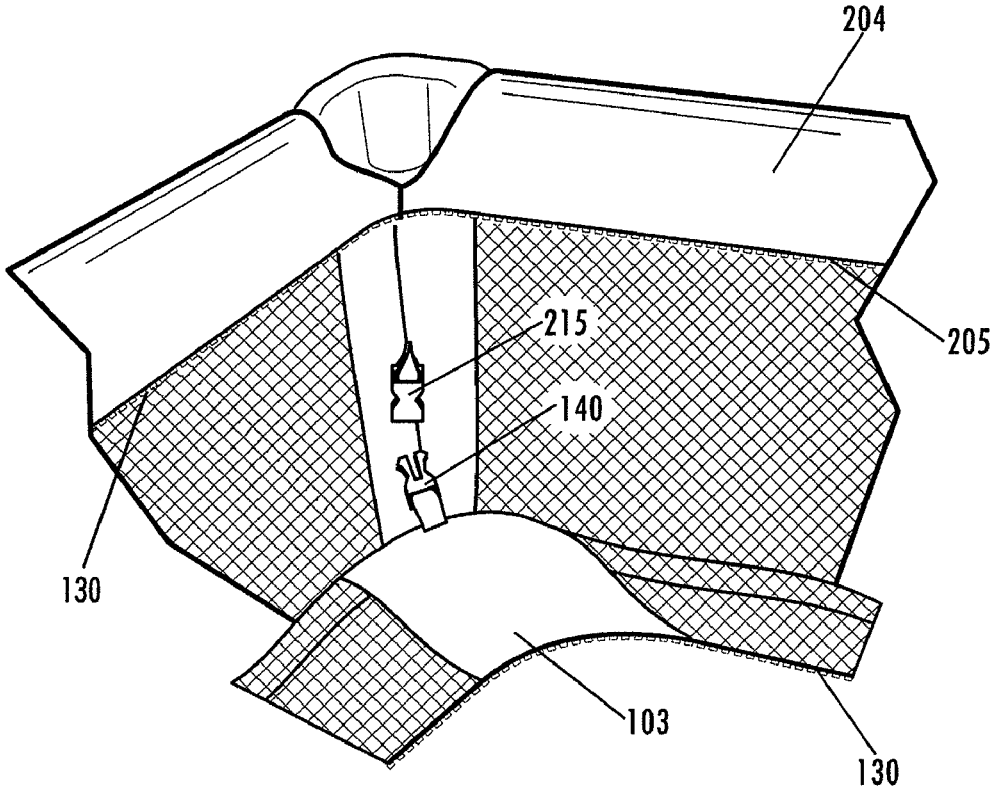

FIG. 4 illustrates a partial upper perspective view of the play yard and bassinet assembly combination shown in FIG. 1 in which buckles are not engaged and the bassinet assembly is not secured within the play yard.

Figure 5:
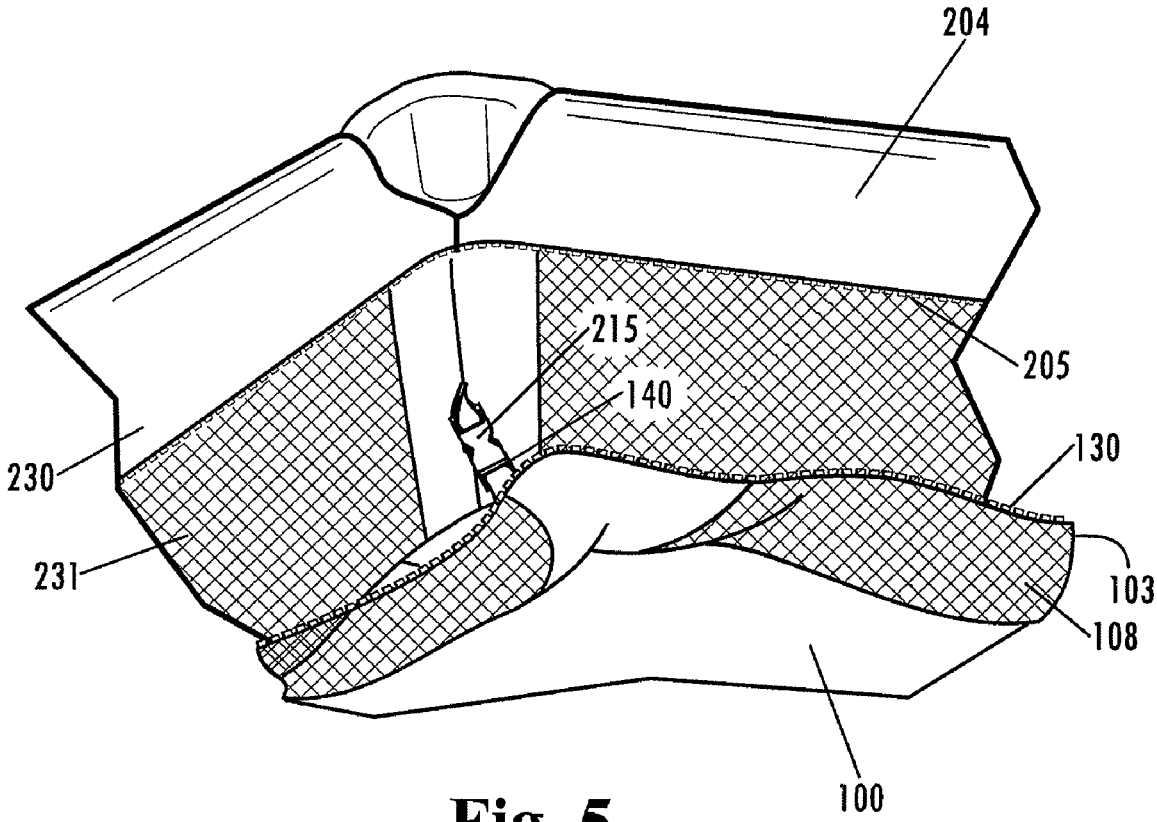

FIG. 5 illustrates a partial upper perspective view of the play yard and bassinet assembly combination shown in FIG. 1 in which buckles are engaged.

Figure 6:
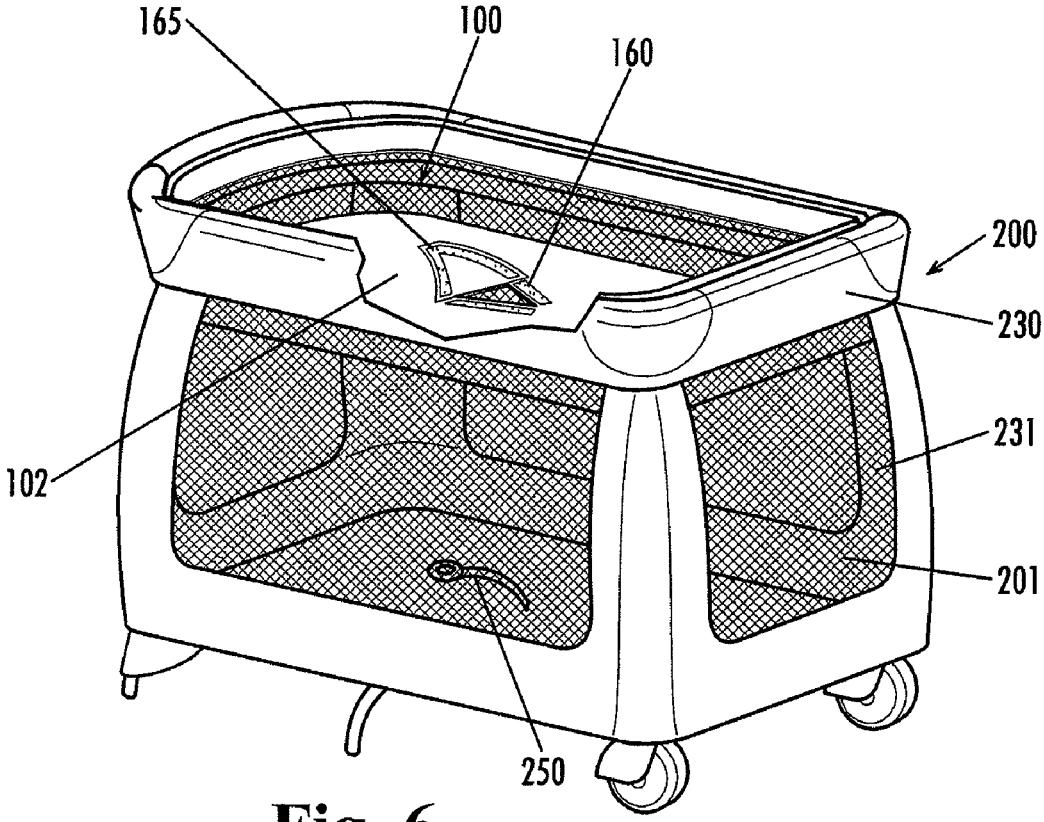

FIG. 6 illustrates an upper perspective view of the play yard and bassinet assembly combination according to one embodiment of the invention.

Figure 7:
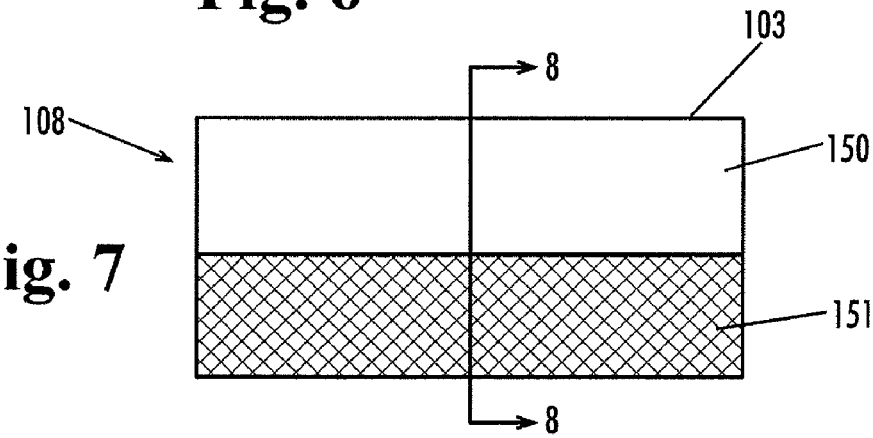

FIG. 7 illustrates a side view of an inner wall of the bassinet assembly according to various embodiments of the invention.

Figure 8:
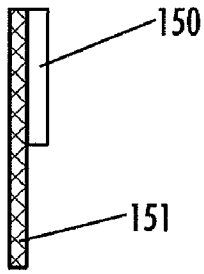

FIG. 8 illustrates a cross sectional view of the inner wall of the bassinet assembly shown in FIG. 7 as taken through the 8-8 line.

Figure 9:
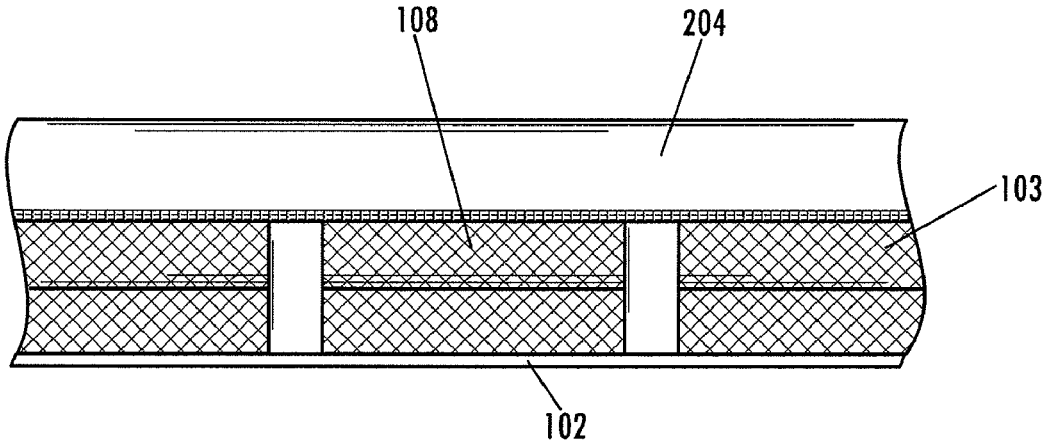

FIG. 9 illustrates a side view of the inner walls of the bassinet assembly and play yard according to the embodiment shown in FIG. 1.

Figure 10:
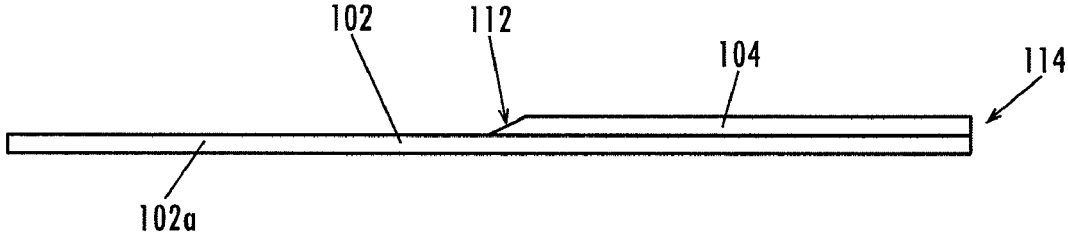

FIG. 10 illustrates an exaggerated side view of a floor and inclinable flap of the bassinet assembly according to the embodiment shown in FIG. 1.

Figure 11:
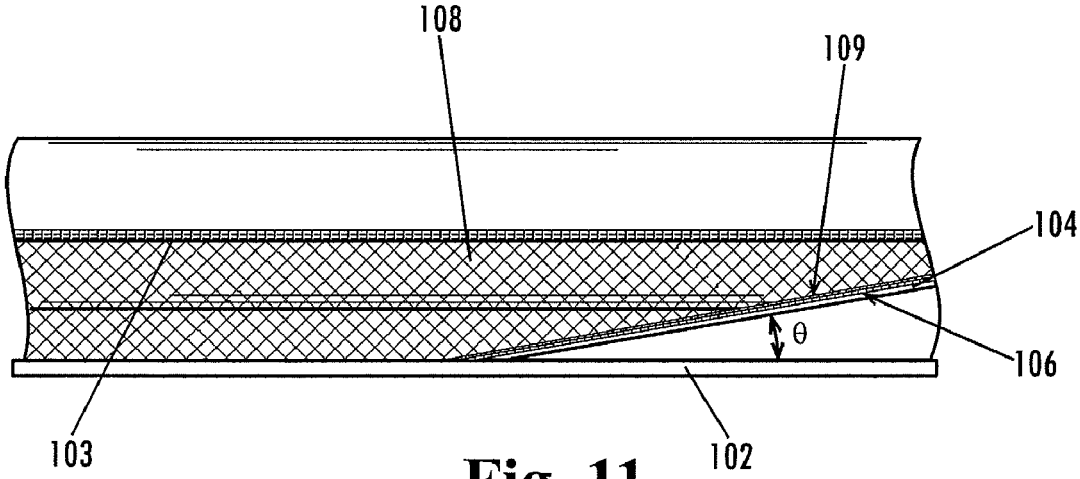
Figure 12:
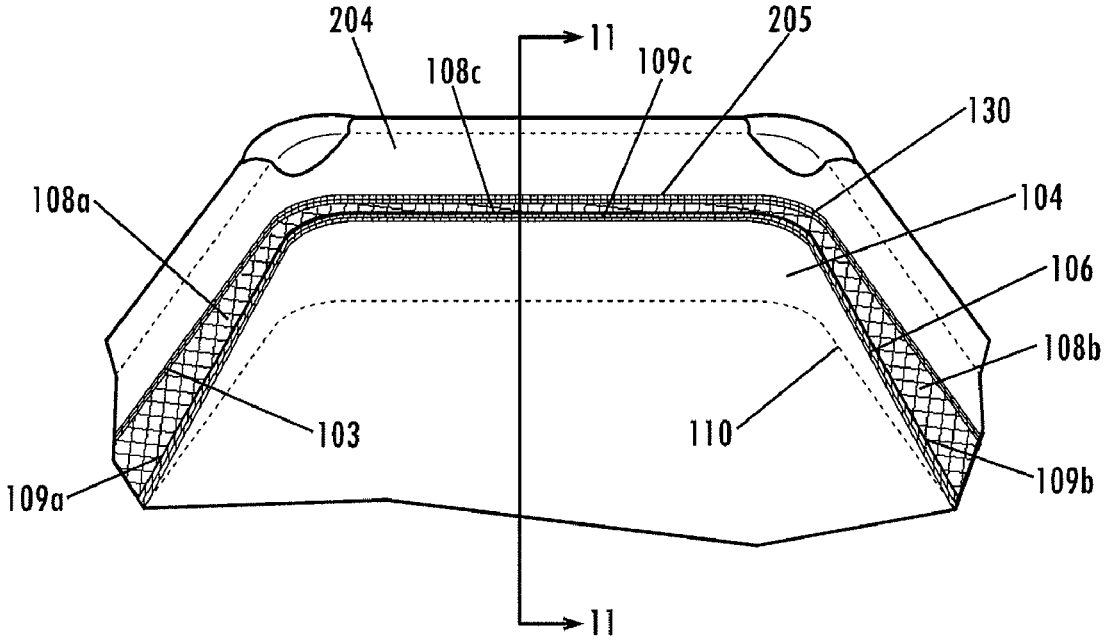

FIG. 11 illustrates a cross-sectional view of the floor and inclinable flap of the bassinet assembly as taken along the 11-11 line in FIG. 12.

FIG. 12 illustrates a partial upper perspective view of the inclinable flap of the bassinet assembly and the side walls of the play yard according to the embodiment shown in FIG. 1.

Figure 13:
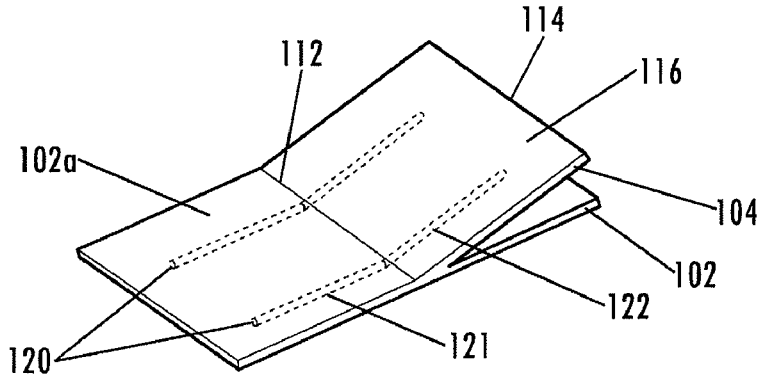

FIG. 13 illustrates an upper perspective view of the floor and inclinable flap of the bassinet assembly when the inclinable flap is positioned at an angle to the floor according to various embodiments of the invention.

Figure 14:
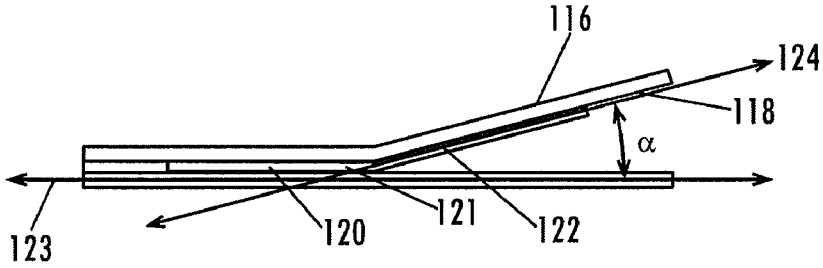

FIG. 14 illustrates a side view of the floor and inclinable flap of the bassinet assembly when the inclinable flap is positioned at an angle to the floor according to the embodiment shown in FIG. 13.

Figure 15:
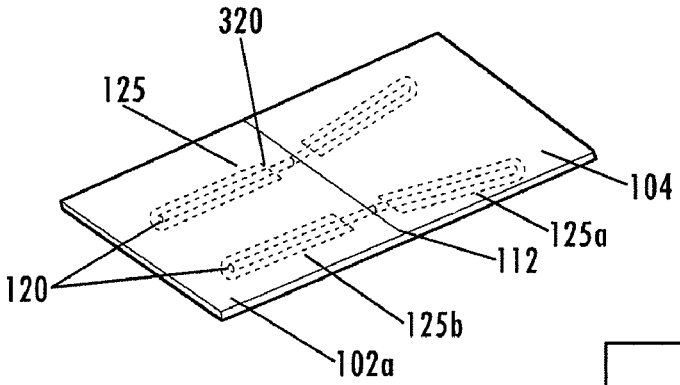

FIG. 15 illustrates an upper perspective view of the floor and inclinable flap of the bassinet assembly when the inclinable flap is laying flat against the floor according to various embodiments of the invention.

Figure 16:
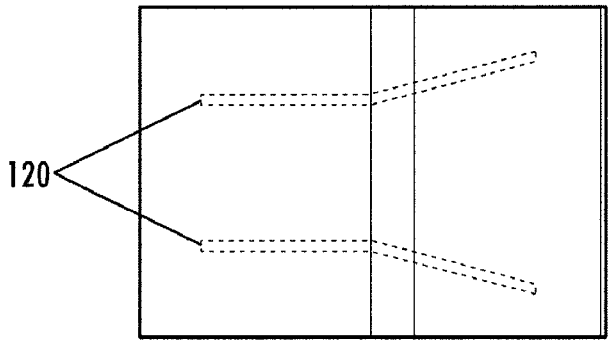

FIG. 16 illustrates a plan view of the floor and inclinable flap of the bassinet assembly according to the embodiment shown in FIG. 15.

Figure 17:
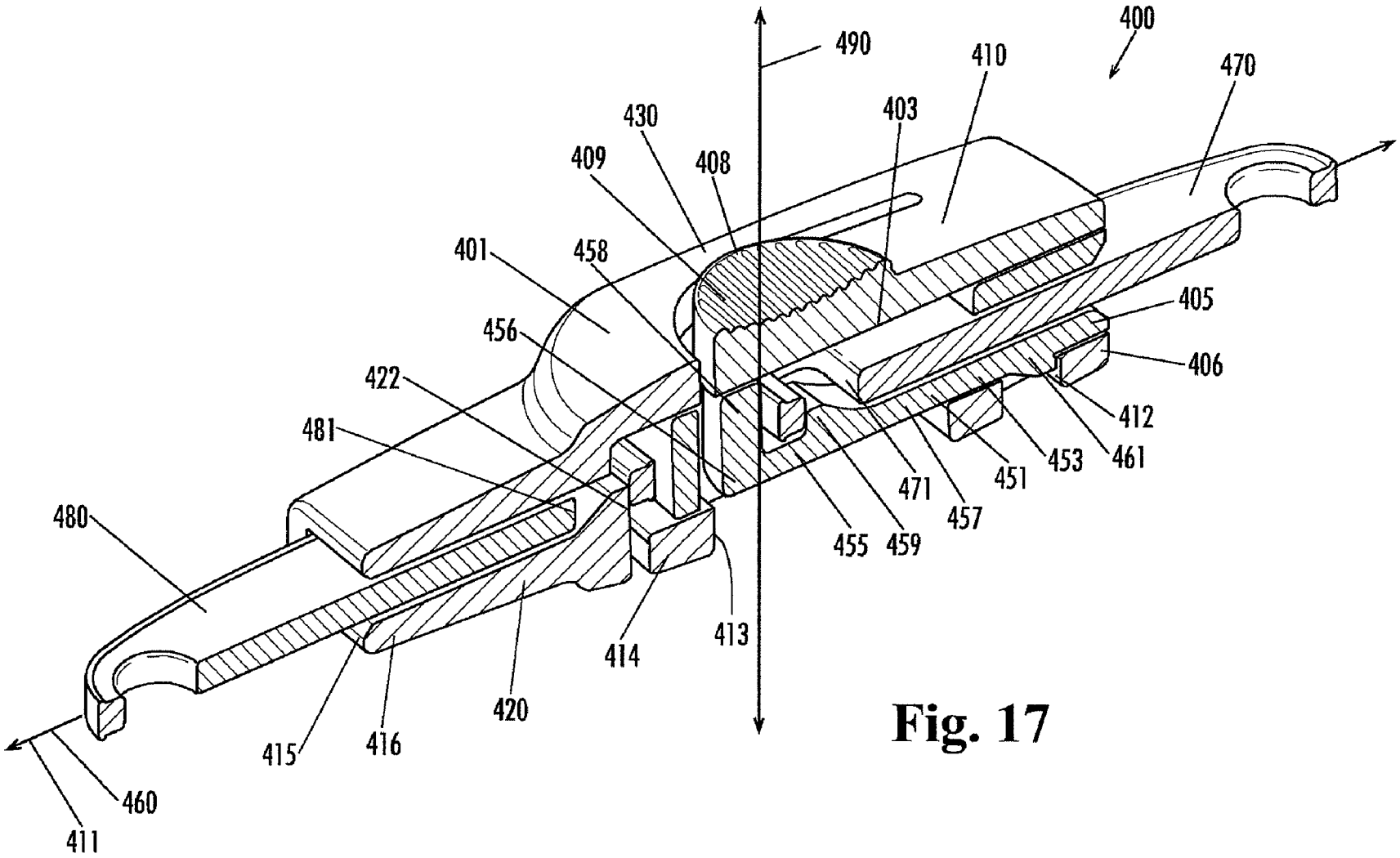

FIG. 17 illustrates a cross sectional upper perspective view of a zipper pull tab lock according to one embodiment of the invention.

Figure 18:
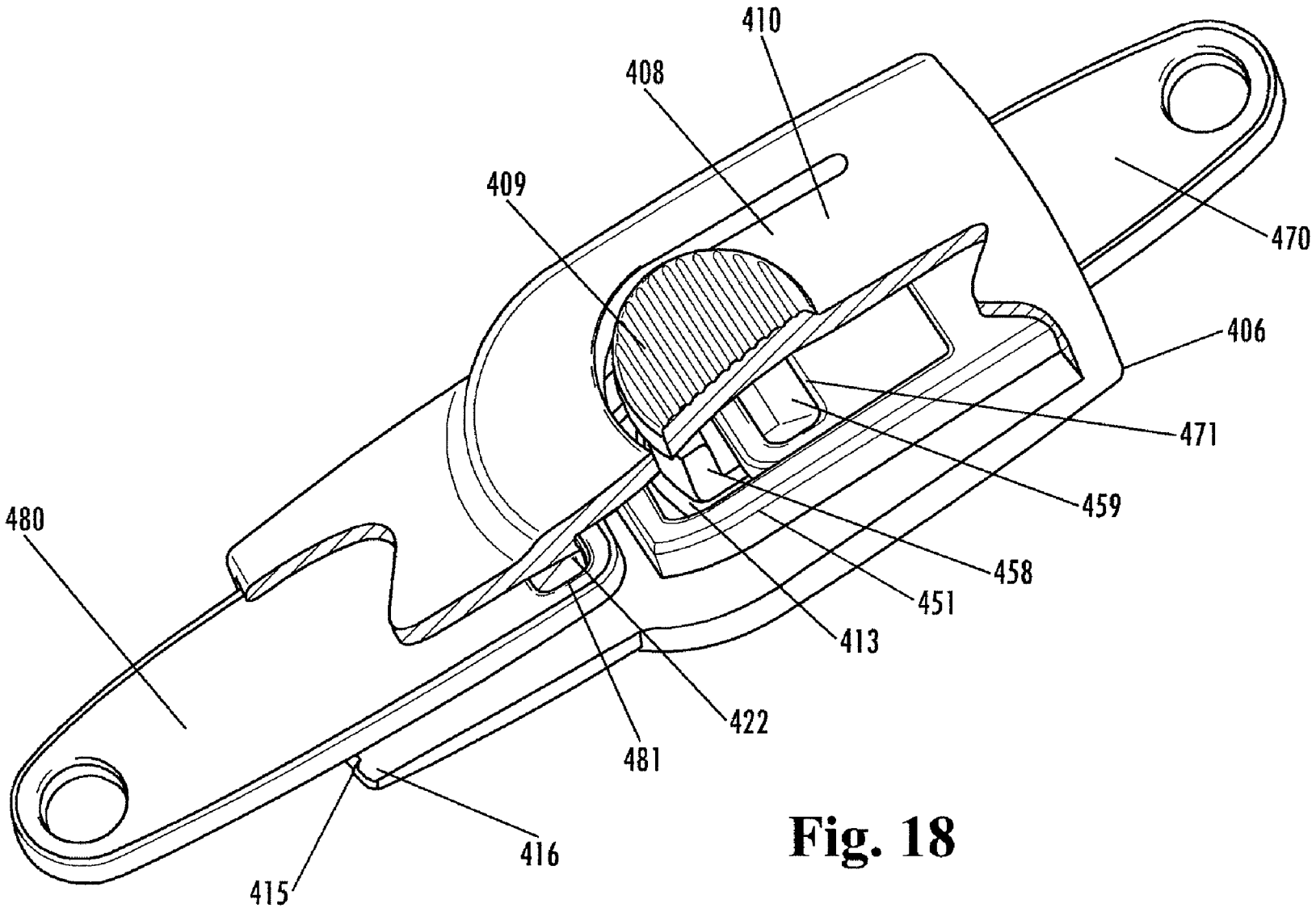

FIG. 18 illustrates an upper perspective view with a partial cut away of the zipper pull tab lock shown in FIG. 17.

Figure 19:
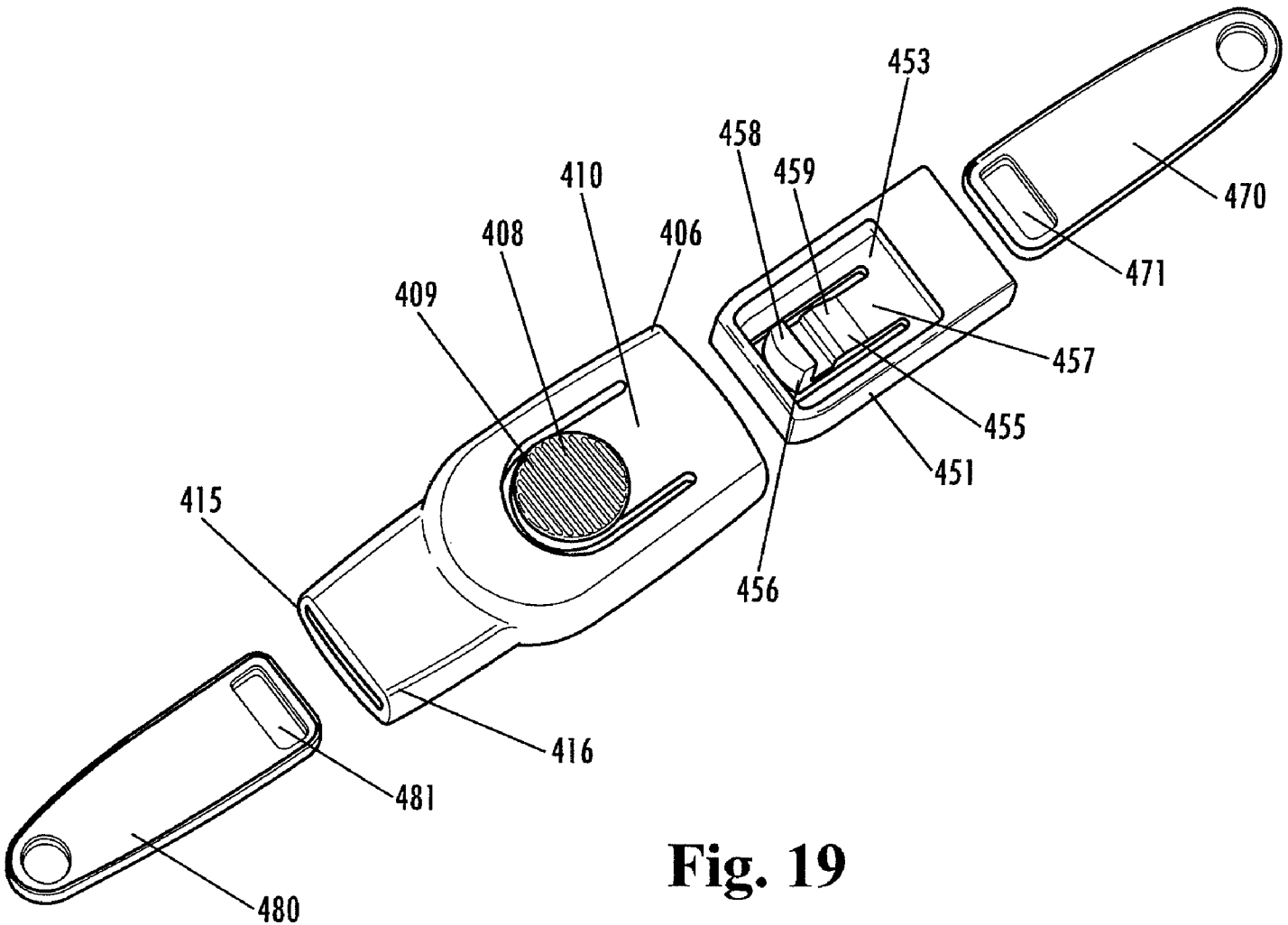

FIG. 19 illustrates an exploded upper perspective view of the zipper pull tab lock shown in FIG. 17.

Figure 20:
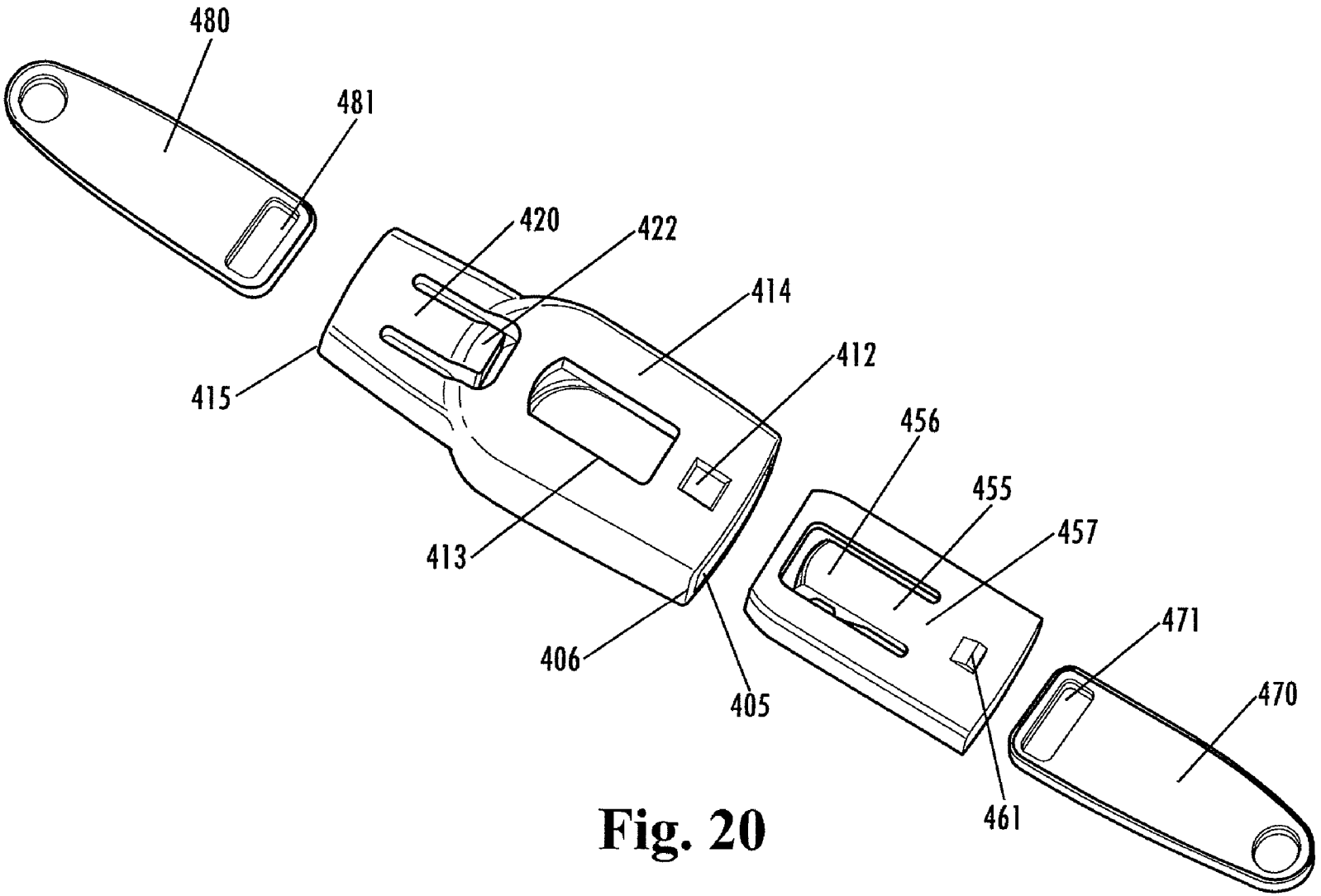

FIG. 20 illustrates an exploded lower perspective view of the zipper pull tab lock shown in FIG. 17.

Figure 21:
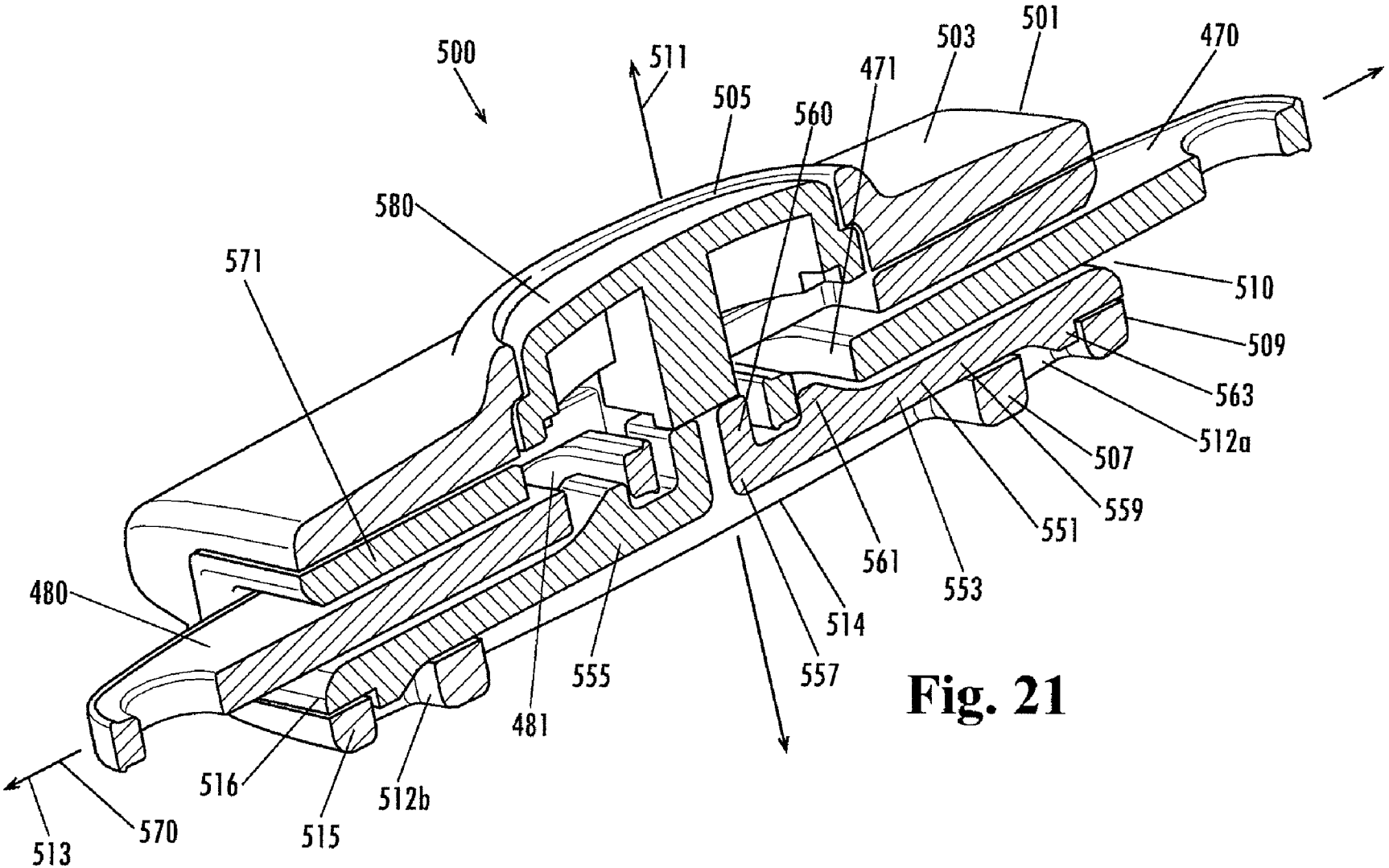

FIG. 21 illustrates a cross sectional upper perspective view of a zipper pull tab lock according to another embodiment of the invention.

Figure 22:
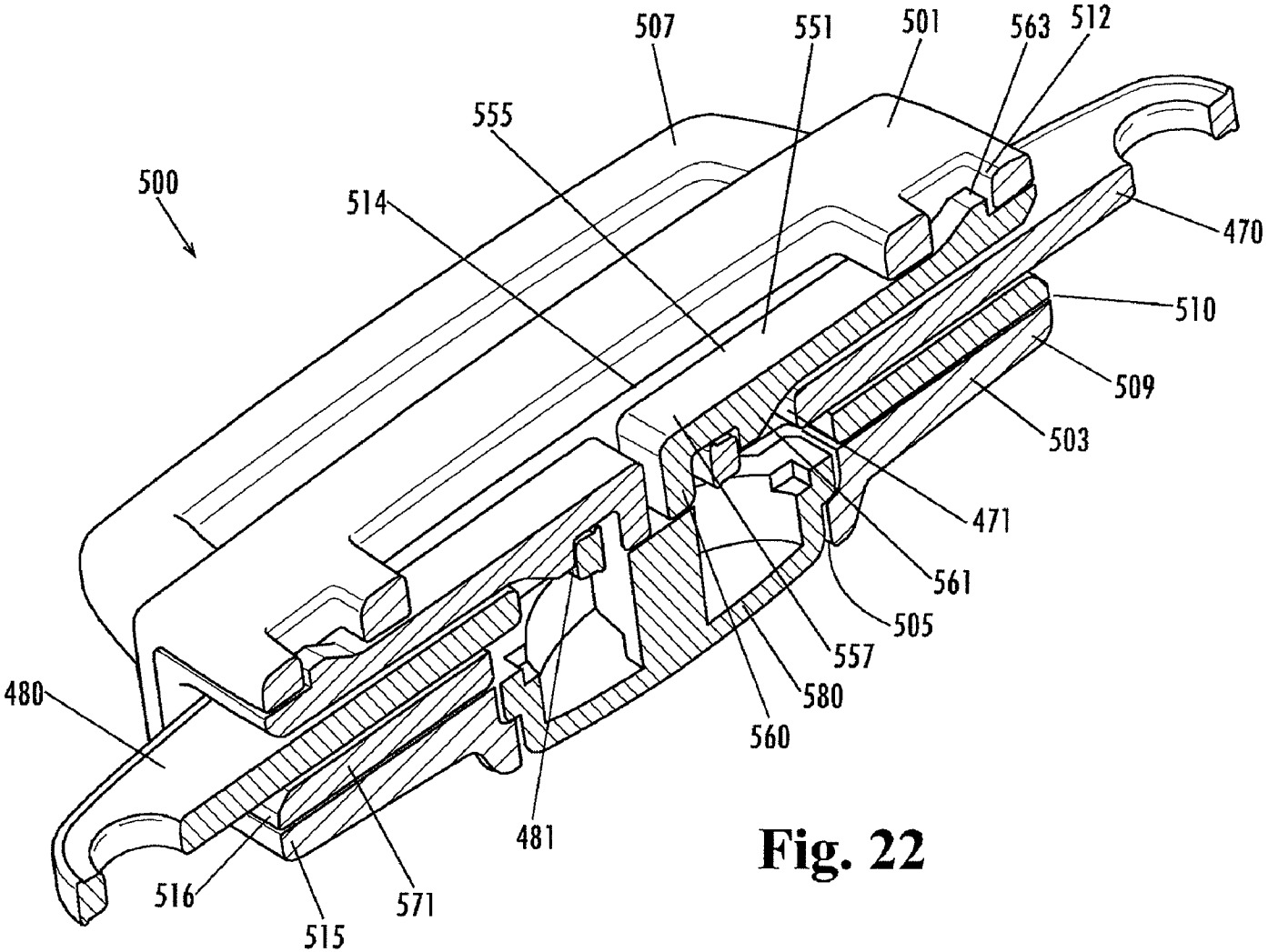

FIG. 22 illustrates a cross sectional lower perspective view of the zipper pull tab lock shown in FIG. 21.

Figure 23:
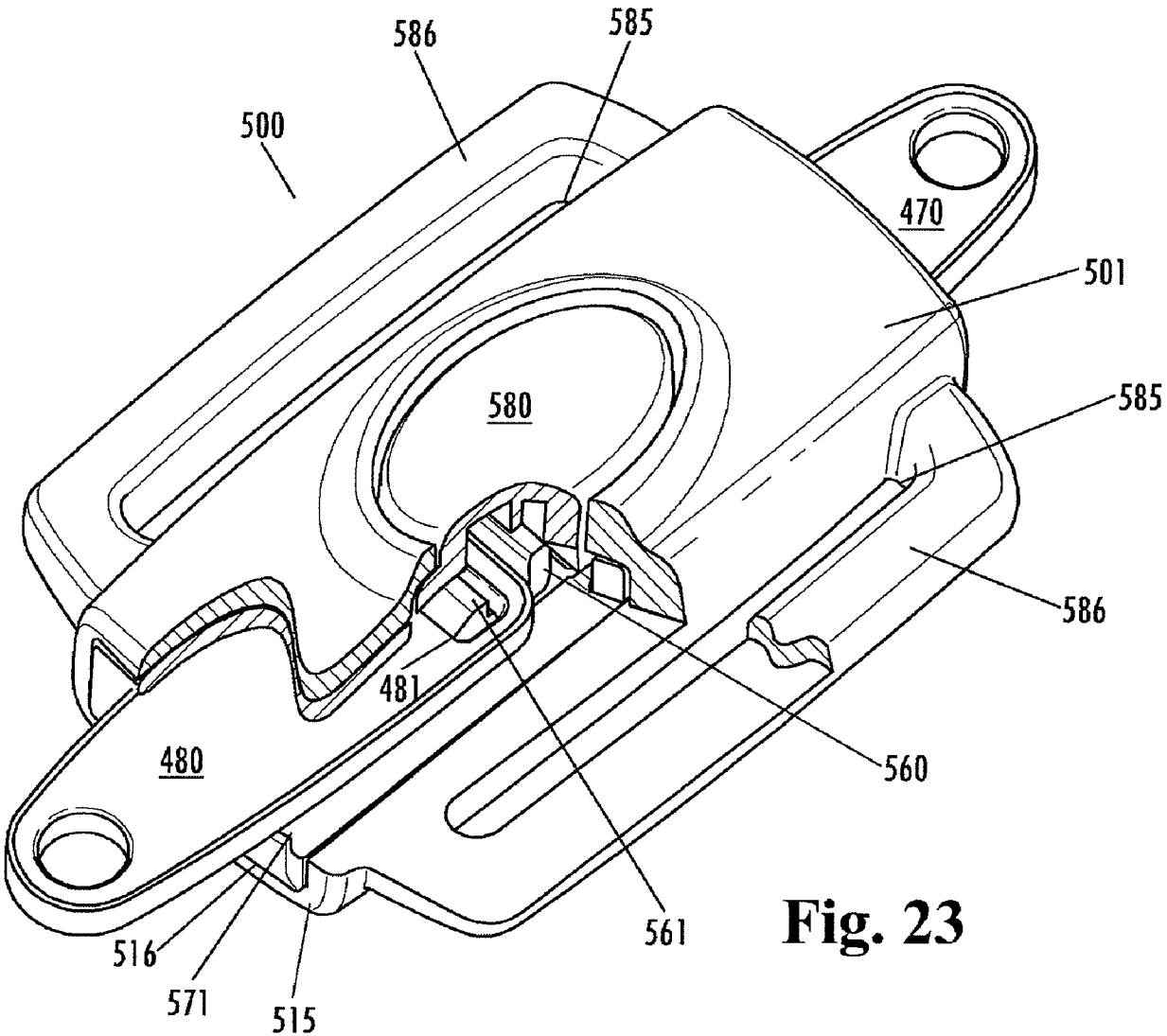

FIG. 23 illustrates an upper perspective view with a partial cut away of the zipper pull tab lock shown in FIG. 21.

Figures 24A, 24B:
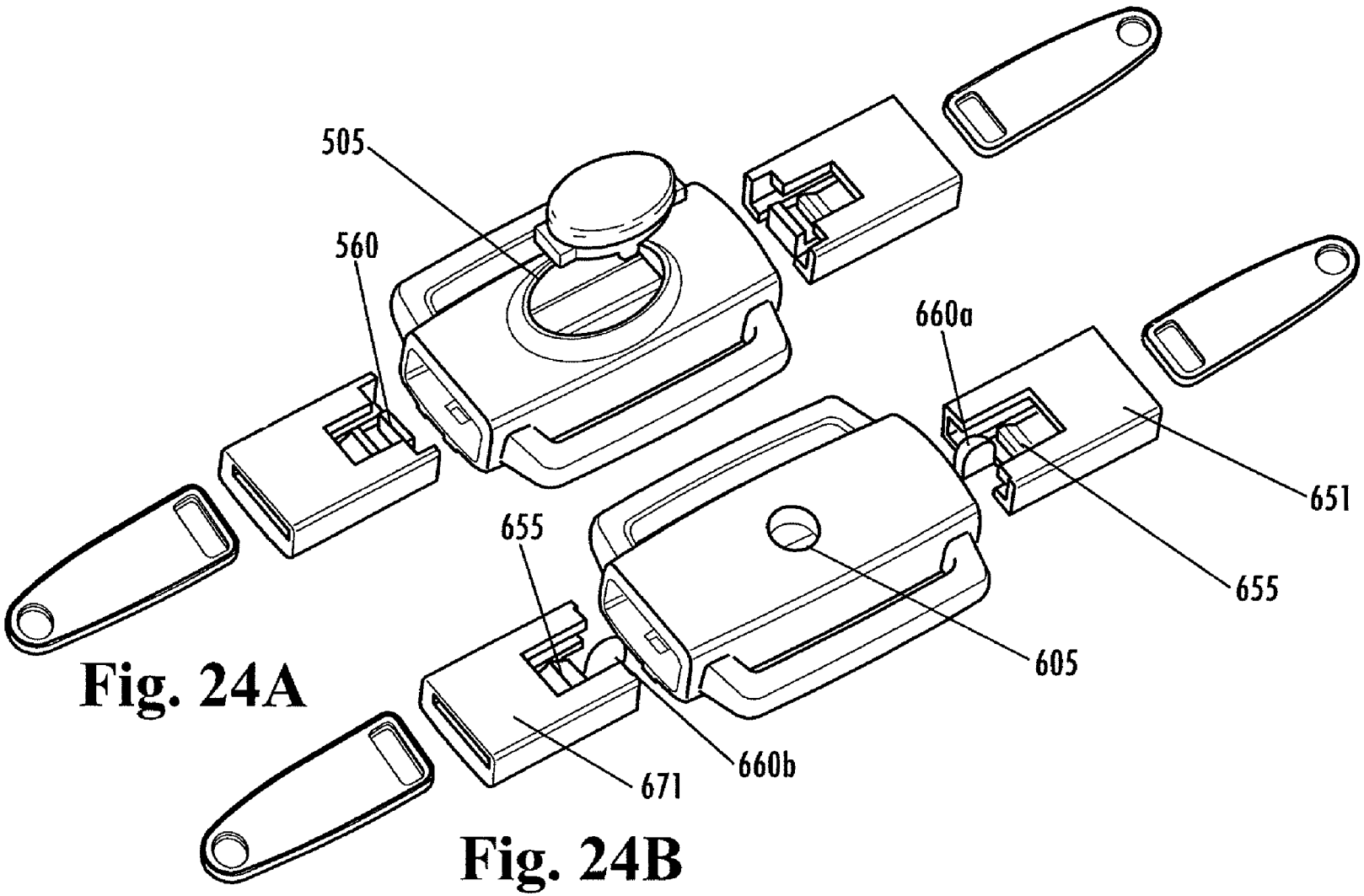

FIG. 24A illustrates an exploded upper perspective view of the zipper pull tab lock shown in FIG. 21.

FIG. 24B illustrates an exploded upper perspective view of a zipper pull tab according to an alternative embodiment.

Figures 25A, 25B:
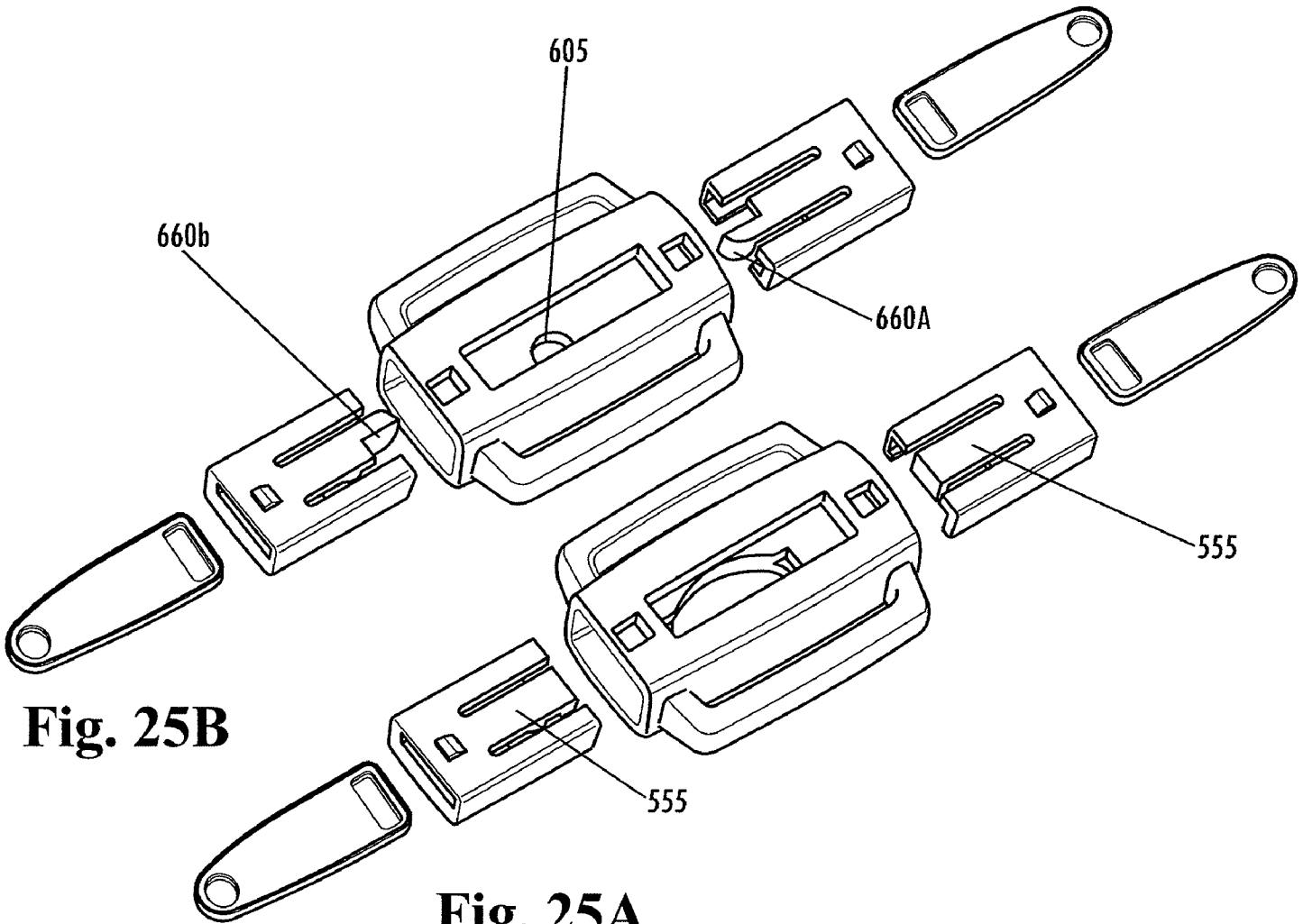

FIG. 25A illustrates an exploded lower perspective view of the zipper pull tab lock shown in FIG. 21.

FIG. 25B illustrates an exploded lower perspective view of the zipper pull tab lock shown in FIG. 24B.

Figure 26:
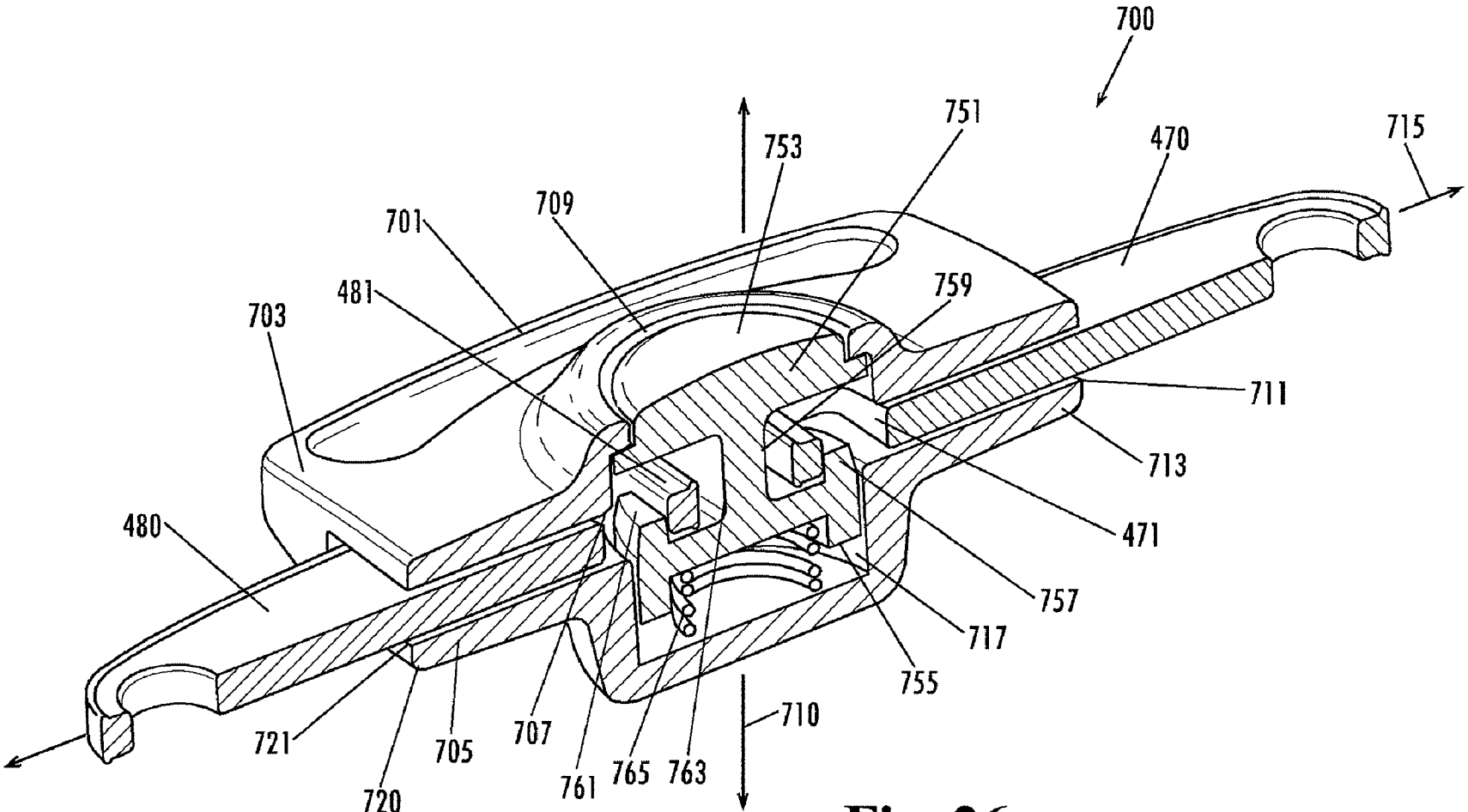

FIG. 26 illustrates a cross sectional upper perspective view of a zipper pull tab lock according to yet another embodiment of the invention.

Figure 27:
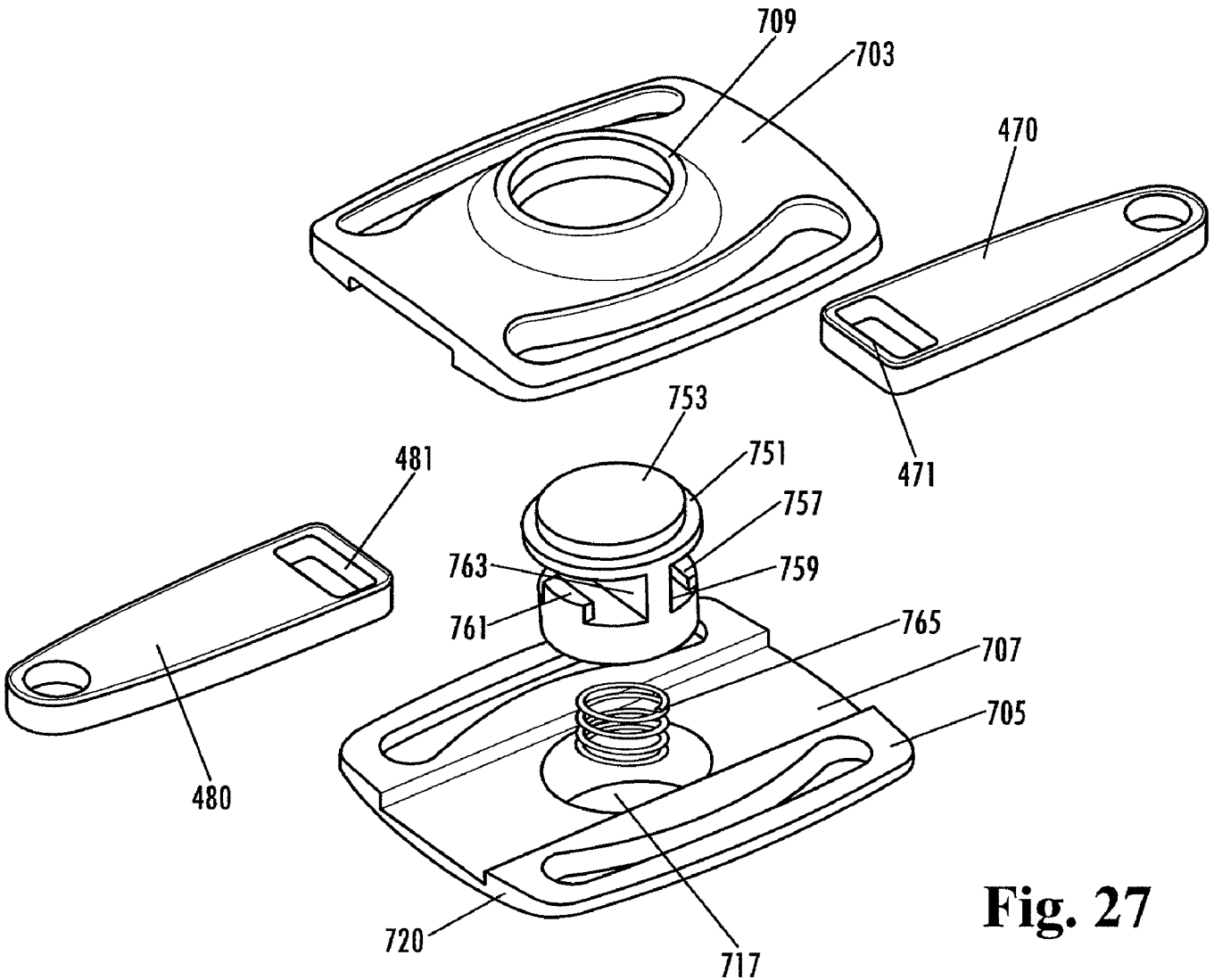

FIG. 27 illustrates an exploded upper perspective view of the zipper pull tab lock shown in FIG. 26.

Figure 28:
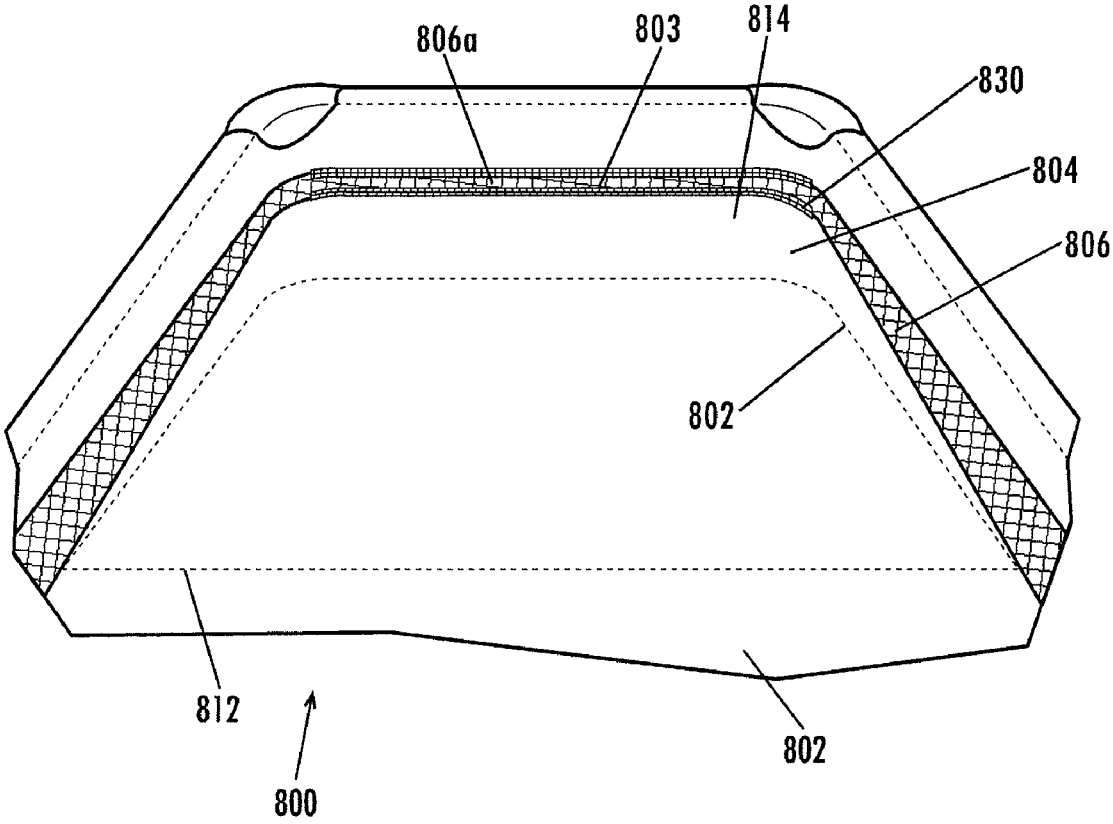

FIG. 28 illustrates a partial upper perspective view of the inclinable flap of the bassinet assembly and the side walls of the play yard according to an alternative embodiment.

DETAILED DESCRIPTION OF VARIOUS EMBODIMENTS OF THE INVENTION

Various embodiments of the invention are described more fully hereinafter with reference to the accompanying drawings, in which some, but not all embodiments of the invention are shown in the figures. These inventions may be embodied in many different forms and should not be construed as limited to the embodiments set forth herein. Rather, these embodiments are provided so that this disclosure will satisfy applicable legal requirements.

Brief Summary

Various embodiments of the invention provide an improved play yard and bassinet combination. For example, FIG. 1 illustrates a play yard and bassinet combination 50 according to various embodiments of the invention in which the bassinet assembly 100 is secured adjacent the inner walls of the play yard 200 with a zipper. In particular, the play yard 200 includes four walls 206 and a floor 207, and an inner portion 204 of the walls 206 adjacent the upper perimeter of the walls 206 includes a row of zipper teeth 205 (shown in FIGS. 3-5). The bassinet assembly 100 includes a floor 102 and side walls 108 that extend upwardly from the floor 102. The upper edge of the side walls 108 includes a row of teeth 130 (shown in FIGS. 3-5), and one or more zippers engage the teeth 130 of the bassinet assembly 100 with the corresponding row of teeth 205 on the play yard 200 to attach the bassinet assembly 100 to the inner portion 204 of the side walls 206 of the play yard 200.

To provide an added layer of support should a primary means (e.g., zipper, U-shaped hooks, metal rod/hook arrangement) for securing the bassinet assembly 100 within the play yard 200 fail, the bassinet assembly 100, according to various embodiments, further includes a plurality of male or female buckles 140 spaced around the outer perimeter of the bassinet floor 102, and the buckles 140 mate with corresponding female or male buckles 215 (shown in FIGS. 4-5), respectively, attached to portions of side walls 206 of the play yard 200. If the primary means for securing the bassinet assembly 100 were to fail, the engaged buckles 140, 215 would prevent the bassinet floor 102 from dropping towards the floor 207 of the play yard 200.

In addition, as shown in FIG. 6, according to various embodiments, the bassinet assembly 100 defines an opening 160 in a medial portion of the floor 102 through which a user can access a release mechanism 250 on the floor 207 of the play yard 200 to collapse the play yard 200 without removing the bassinet assembly 100 from the play yard 200. In the embodiment described above in relation to FIG. 1 in which the bassinet assembly 100 is secured to the play yard 200 using a zipper or other flexible fastener, the play yard 200 can be collapsed without removing the bassinet assembly 100 from the upper opening of the play yard 200.

The bassinet assembly 100 is further configured to provide an inclined surface for a baby. According to various embodiments, as shown in FIGS. 1 and 10-12, the floor 102 of the bassinet assembly 100 includes an inclinable flap 104, and the inclinable flap 104 includes a row of zipper teeth 106 along a portion of the perimeter of the inclinable flap 104. Three adjacent side walls 108 of the bassinet assembly 100 include a corresponding row of zipper teeth 109 between an upper and lower perimeter of the side walls 108. In particular, on two opposing side walls 108*a*, 108*b*, the row of zipper teeth 109 is disposed along an inclined path relative to the floor 102, and on a side wall 108*c* intermediate the two opposing side walls 108*a*, 108*b*, the row of zipper teeth 109 is disposed along a path parallel to the floor 102. The rows of teeth 106, 109 are engaged with one or more zippers to secure the inclinable flap 104 at an angle with respect to the floor 102. For example, in one embodiment, the angle of incline is about 10°.

In other various embodiments, the bassinet assembly 100 may further include at least one rod 120 that is disposed below at least a portion of an upper surface of the bassinet floor 102 to support a mattress pad 300 to be disposed on the upper surface of the bassinet floor 102. In one embodiment, each rod 120 includes a static portion 121 and an inclined portion 122, and the longitudinal axes 123, 124 of each portion 121, 122, respectively, are disposed at an angle to each other (e.g., about 10°). Each rod 120 is at least partially disposed in one or more pockets 125 that are attached below the upper surfaces of the floor 102 and the inclinable flap 104 of the bassinet assembly 100 such that the static portion 121 is below a first half 102*a* of the floor 102 and the inclined portion 122 is below the inclinable flap 104. When the inclinable flap 104 is pulled upwardly, each rod 120 rotates from a flat position, which is shown in FIGS. 15 and 16, to an inclined position, which is shown in FIGS. 13 and 14. Similarly, when the inclinable flap 104 of the floor 102 is lowered to the flat position, each rod 120 rotates from the inclined position to the flat position.

According to various embodiments, the bassinet assembly 100 and the play yard 200 may utilize zipper pull tab locks for releasably securing zipper pull tabs to prevent the zippers from movement relative to rows of zipper teeth. Exemplary zipper pull tab locks that may be utilized are described in relation to FIGS. 17-27.

Various features of a bassinet assembly and a play yard and bassinet assembly combination according to various embodiments are described below.

Bassinet Assembly

FIG. 1 illustrates the bassinet assembly 100 according to various embodiments of the invention. The bassinet assembly includes the floor 102 and four side walls 108 that extend upwardly from the floor 102. As mentioned above, the side walls 108 have an upper perimeter 103, and a row of zipper teeth 130 (shown in FIGS. 3-5) is disposed along at least a portion of the upper perimeter of the side walls 108. One or more zippers engage the row of zipper teeth 130 along the upper perimeter 103 of the side walls 108 with the row of teeth 205 disposed along the inner portion 204 of the play yard 200 to removably secure the bassinet assembly 100 within the play yard 200, which is shown in FIGS. 3, 6, and 9.

In various embodiments of the invention, the floor 102 of the bassinet assembly 100 includes an inclinable flap 104. According to the embodiment shown in FIG. 10, the inclinable flap 104 is attached to the bassinet floor 102 at one edge 112 of the flap 104, and the remaining edges 114 include zipper teeth 106 along at least a portion of the edges 114. In a particular embodiment, the edge 112 is integrally formed with the bassinet floor 102. In an alternative embodiment, the edge 112 may be sewn or otherwise fastened to the bassinet floor 102. In addition, according to various embodiments, the length of the flap 104 may be substantially less than or equal to the length of the bassinet floor 102. For example, in the embodiment shown in FIGS. 1, 10, and 13-16, the flap 104 is approximately half the length of the floor 102 and is attached to the bassinet floor 102 along a medial portion of the floor 102.

In addition, in the embodiment shown in FIGS. 11 and 12, corresponding rows of zipper teeth 109 are disposed on at least a portion of the one or more side walls 108*a*, 108*b*, 108*c* between the upper perimeter 103 of the side walls 108*a*, 108*b*, 108*c* and the floor 102. A first portion 109*a* and a second portion 109*b* of the corresponding row of zipper teeth 109 are disposed on opposing side walls 108*a* and 108*b* along an inclined path at an angle θ to the floor 102, and a third portion 109*c* of the row of teeth 109 is disposed on side wall 108*c*, which is intermediate side walls 108*a* and 108*b*, along a path that is substantially parallel to the floor 102. When one or more zippers are engaged with the row of zipper teeth 106 along the edges 114 of the inclinable flap 104 and the row of zipper teeth 109 along the side walls 108*a*-108*c*, the inclinable flap 104 is secured at the angle θ with respect to the floor 102. The one or more zippers are disengaged with the rows of zipper teeth 106, 109 to allow the inclinable flap 104 to lay substantially flat against the floor 102.

According to various embodiments, the angle θ may be between about 5° and 15°, and in the embodiments shown in FIGS. 1 and 11-14, the angle θ is about 10°. In addition, according to various embodiments, more than one zipper may be utilized to secure the rows of zipper teeth 106, 109. In an alternative embodiment (not shown), the flap 104 may be secured at the angle θ using snap fasteners disposed around the outer perimeter of the flap 104 that mate with corresponding snap fasteners disposed along the side walls 108*a*-*c*. In addition, according to various alternative embodiments, other fasteners, such as clips, hook and loop, snaps, or buckles, for example, may be used to secure the inclinable flap or floor at an angle with respect to the support surface.

In one embodiment, the one or more zippers includes a first zipper and a second zipper disposed in an in-line arrangement such that the first zipper and the second zipper are disposed adjacent each other when the inclinable flap is secured at the angle of the inclined path relative to the floor. In another embodiment, the one or more zippers consist of one zipper. In yet another embodiment, the one or more zippers include three zippers that are each disposed on a separate side wall 108*a*-108*c*.

In one alternative embodiment (not shown), the floor does not include a separate inclinable flap, and a first set of fasteners are disposed along at least a portion of a perimeter the floor. A second set of mating fasteners are disposed along at least a portion of one or more side walls of the bassinet assembly between the upper perimeter and the lower perimeter of the one or more side walls, and the first set of fasteners are engaged with the second set of fasteners to secure the floor at an angle greater than 0° with respect to the support surface. In addition, a third set of fasteners are disposed substantially adjacent the lower perimeter of at least a portion of the one or more side walls, and the first set of fasteners are engaged with the third set of fasteners to secure the floor at an angle substantially equal to 0° with respect to the support surface.

In various embodiments, as shown in FIGS. 13-16, the inclinable flap 104 includes an upper surface 116 and a lower surface 118, and one or more rods 120 are each disposed below the lower surface 118 of the inclinable flap 104. Each of the one or more rods 120 includes a static portion 121 that has a first longitudinal axis 123 and an inclined portion 122 that has a second longitudinal axis 124. The first longitudinal axis 123 and the second longitudinal axis 124 intersect at an angle α substantially equal to the inclined angle θ. When the inclinable flap 104 is raised relative to the floor 102, each rod 120 rotates about the first longitudinal axis 123 such that the first 123 and second longitudinal axes 124 are in a plane substantially perpendicular to the support surface 10. When the inclinable flap 104 is allowed to lay substantially flat against the floor 102, each rod 120 rotates about the first longitudinal axis 123 such that the first 123 and second longitudinal axes 124 are in a plane substantially parallel to the support surface 10. For example, in the embodiment shown in FIGS. 13 and 14, the longitudinal axes 123, 124 intersect at an angle of about 10° such that when the inclinable flap 104 is raised above the floor 102 and secured to the side walls 108*a*-108*c*, the second longitudinal axis 124 forms an angle with the floor 102 of about 10°.

According to the embodiment shown in FIG. 15, each rod 120 is disposed within a pocket 125 that is sewn or otherwise attached to the lower surface 118 of the inclinable flap 104 and below an upper surface of the floor 102. In one embodiment, for example, a first pocket 125*a* is sewn between the upper surface and the lower surface of the floor 102 and a second pocket 125*b* is sewn to the lower surface of the inclinable flap 104. Each pocket 125*a*, 125*b* has an opening 320 adjacent the edge 112 of the flap 104 through which rods 120 can be inserted into and removed from the pockets 125*a*, 125*b*. In various other embodiments, each rod 120 may be secured relative to the lower surface of the inclinable flap 104 using straps, clips, or hook and loop fasteners (not shown), for example.

In various alternative embodiments (not shown), the floor 102 (or the inclinable flap 104) of the bassinet assembly 100 is inclinable along substantially the entire length of the floor 102. In one such embodiment, one or more straight rods are disposed below the floor 102 (and/or inclinable flap 104) of the bassinet assembly 100 such that the longitudinal axis of each straight rod is oriented substantially parallel with the longitudinal axis of the floor 102.

FIGS. 7 and 8 illustrate a mesh arrangement for the side walls 108 of the bassinet assembly 100 according to one embodiment of the invention. In particular, the side walls 108 include a mesh portion 151 that extends substantially the height of the side wall 108 from the floor 102 to the upper perimeter 103 of the side walls 108, and a substantially solid wall portion 150 (e.g., a solid fabric portion or a bumper portion) extends from the upper perimeter 103 of the side walls 108 to an intermediate portion of the side walls 108 between the upper perimeter 103 and the floor 102. A child lying in the bassinet 100 can breathe through the mesh portion 151 of the side walls 108 that is disposed below the substantially solid wall portion 150.

FIG. 6 illustrates an embodiment of the bassinet assembly 100 according to various embodiments of the invention in which the floor 102 of the bassinet assembly 100 further defines an opening 160 therethrough. In one embodiment, the opening 160 is defined through a medial portion of the floor 102. A user can access the release mechanism 250 of the play yard 200 through the opening 160 without removing the bassinet assembly 100 from the play yard 200. The opening 160 may be shaped like a triangle, as shown in the embodiment in FIG. 6, or, in various other embodiments, it may have a different shape, such as a rectangular shape, a circular shape, or a hexagonal shape. In addition, according to various embodiments, the release mechanism 250 can be, for example, a strap, a handle, or a button.

In a particular embodiment, the floor 102 of the bassinet assembly 100 further includes a hatch 165 that is securable over the opening 160. According to one embodiment, a hook (or loop) fastener strip is disposed along at least a portion of a perimeter of the hatch 165, and a loop (or hook) fastener strip is disposed along at least a portion of a perimeter of the opening 160 such that the hook and loop fasteners may be engaged to removably secure the hatch 165 over the opening 160. Other fasteners for removably securing the hatch 165 over the opening 160 may include one or more snap fasteners, zippers, buttons, or other suitable fastener.

According to an alternative embodiment shown in FIG. 28, the bassinet assembly 800 includes a floor 802 that includes an inclinable flap 804 and one or more side walls 806 that extend upwardly from a perimeter of the floor 802 and surround the floor 802. The inclinable flap 804 is disposed adjacent the floor 802 along a first edge 812 of the inclinable flap 804, and the inclinable flap 804 includes a first row of teeth 830 for engaging one or more zippers disposed along at least a portion of a second edge 814 of the inclinable flap 804, wherein the second edge 814 is spaced apart from the first edge 812.

In addition, the one or more side walls 806 have an upper perimeter and a lower perimeter, and the lower perimeter is adjacent the floor 802. A second row of teeth 803 for engaging the one or more zippers is disposed on at least a portion of a first side wall 806*a*, which is spaced apart from the first edge 812 of the inclinable flap 804, and the second row of teeth 803 are disposed between the upper perimeter and the lower perimeter of the first side wall 806*a* along a path that is substantially parallel to the floor 802 and spaced above the floor 802. The one or more zippers are engageable with the first row of teeth 830 and the second row of teeth 803 to join the first row of teeth 830 adjacent the second row of teeth 803 and to secure the inclinable flap 804 at an angle greater than 0° relative to the floor 802. The one or more zippers are disengageable with the first row of teeth 830 and the second row of teeth 803 to allow the inclinable flap 804 to lay substantially flat against the floor 802.

In a particular embodiment, the first edge 812 of the inclinable flap 804 is integrally formed with the floor 802. In another embodiment (not shown), the first edge 812 of the inclinable flap 804 is sewn or otherwise attached to the floor 802.

Play Yard

FIG. 2 illustrates a play yard 200 according to various embodiments of the invention. The play yard 200 includes upper horizontal frame members 202 and lower horizontal frame members 208 that are joined together by vertical frame members 210. The frame members 202, 208, 210 may be collapsed and folded together for storage and/or transportation of the play yard 200. In one embodiment, the frame members 202, 208, 210 are joined together by hinges that lock to prevent movement of the frame members 202, 208, 210 relative to each other when the play yard is expanded. Release buttons are provided along the frame members 202, 208, 210 to release (or unlock) the hinges to allow the frame members 202, 208, 210 to move relative to each other, which allows the play yard 200 to be collapsed for storage and/or transportation. In addition, a release mechanism 250 is provided at a medial portion of the lower horizontal frame members 208 along a central vertical axis 260 of the play yard 200. When the release mechanism 250 is actuated, the hinges, which may be part of the lower horizontal frame members, are unlocked (or unlockable), and the lower horizontal frame members 208 are able to be folded upwardly with respect to the vertical frame members 210, the upper horizontal frame members 202 are released (or are able to be released) and able to be folded downwardly with respect to the vertical frame members 210, and the vertical frame members 210 are able to be moved inwardly toward the vertical axis 260, collapsing the play yard 200. In one embodiment, the release mechanism 250 is a strap as shown in FIG. 2, and the strap is pulled upwardly away from the lower horizontal frame members 202 to collapse the play yard 200. In alternative embodiments, the release mechanism is a handle or button, for example.

The lower ends 212 of two vertical frame members 210 adjacent the support surface 10 may each include a wheel 214, and the lower ends 212 of the other two vertical frame members 210 may include stops 216 to prevent the play yard 200 from rolling.

In the embodiment shown in FIG. 1, the frame members 202, 208, 210 are covered with fabric material to form four substantially vertical side walls 206 and a floor 207 suspended above a support surface 10. The upper perimeters of the substantially vertical side walls 206 define an opening through which a child may be moved in or out of the play yard 200. The fabric material forming the floor 207 is a substantially solid material, and the fabric material forming each side wall 206 includes a substantially solid fabric material portion 230 adjacent the frame members 202, 208, 210 and a mesh portion 231 extending between the substantially solid fabric material portions 230 over a central portion of each side wall 206. In one embodiment (not shown), the mesh material 231 extends over a portion of the solid fabric material portion 230.

As discussed above, various embodiments of the play yard 200 include a zipper attachment feature along the inner surface 204 of the side walls 206 of the play yard 200 to attach the bassinet assembly 100 within the play yard 200. In particular, as shown in FIGS. 1 and 3, a row of zipper teeth 205 is disposed below an upper perimeter of the play yard 200 and extends along the inner surface 204 of the side walls 206 of the play yard 200. In a particular embodiment, the row of zipper teeth 205 are attached to a lower edge of the solid material portion 230 that extends over the upper horizontal frame members 202. In one embodiment, the row of zipper teeth 205 may be disposed about four to about six inches below the upper perimeter of the side walls 206. As discussed below, one or more zippers engage the row of zipper teeth 205 and a corresponding row of zipper teeth 130 attached to the upper perimeter 103 of the side walls 108 of the bassinet assembly 100 to secure the bassinet assembly 100 within the play yard 200. According to one embodiment, the row of zipper teeth 205 may be attached to the solid material 230 by sewing or welding a fastener tape to which the rows of teeth 205 are attached to the solid material 230 along the inner surface 204 of the side walls 206. In addition, according to various embodiments, the zippered enclosure eliminates gaps that may cause entrapment of an infant lying within the bassinet assembly 100.

In one embodiment, the one or more zippers includes a first zipper and a second zipper disposed in an in-line arrangement such that the first zipper and the second zipper are disposed adjacent each other when the bassinet assembly 100 is fully secured adjacent the upper perimeter of the play yard 200. In another embodiment, the one or more zippers include four zippers that are each disposed on a separate side wall. In yet another embodiment, the one or more zippers consists of one zipper.

According to a particular embodiment shown in FIG. 1, a lower perimeter 201 of the side walls 206 adjacent the lower horizontal frame members 208 of the play yard 200 form a substantially rectangular shape and the upper perimeter of the side walls 206 of the play yard 200 adjacent the upper horizontal frame members 202 form a semi-rectangular shape. In particular, the side walls 206 include one side wall that has an arcuate shape at its upper perimeter and three side walls that intersect at substantially 90° angles to each another at their upper perimeter. However, according to various other embodiments, the shape of the play yard can be substantially rectangular, substantially oval, or substantially circular, for example.

Redundant Support Feature for Bassinet Assembly Secured with the Play Yard

According to various embodiments, the bassinet assembly and play yard combination includes one or more redundant support features that provide additional vertical support for the bassinet assembly and prevent the bassinet assembly from falling to the floor of the play yard should a primary attachment means (e.g., zipper, U-shaped hooks, metal rod/hook arrangement, clips, hook and loop, etc.) fail. In a particular embodiment, as shown in FIGS. 4 and 5, a male (or female) buckle 140 is attached to each outer corner of the floor 102 of the bassinet assembly 100, and a female (or male) buckle 215 is attached to each vertical frame member 210. The male buckle 140 is engaged into the female buckle 215 prior to zipping the upper perimeter of the walls 108 of the bassinet assembly 100 to the inner perimeter of the play yard 200, as shown in FIG. 5.

According to one embodiment, the buckles 140 may be attached to the bassinet assembly 100 by sewing one end of a strap to the buckle 140 and the other end of the strap to the floor 102 of the bassinet assembly 100. Similarly, the buckle 215 may be attached relative to the play yard 200 by sewing one end of a strap to the buckle 215 and the other end of the strap to the solid material 230 of the play yard 200. According to various other embodiments, the buckle 215 may be attached relative to the play yard 200 by disposing one end of the strap through or around a vertical frame member 210 of the play yard 200 and sewing the other end of the strap to the buckle 215. In such embodiments, the buckle 215 and portion of the strap adjacent the buckle 215 may be thread through grommets or button holes in the solid material 230 such that the buckle 215 can be engaged with the corresponding buckle 140 attached to the bassinet assembly 100.

In other various embodiments, the redundant support feature may include snaps, clips, clasps, and polypropylene webbing, for example.

Mattress Pad

As shown in FIG. 1, various embodiments may include a mattress pad 300 to fit over floor 207 of the play yard 200, or the pad 300 may be inserted over the floor 102 of the bassinet assembly 100. In the embodiment shown in FIG. 1, the mattress pad 300 includes four sections 301*a*, 301*b*, 302*a*, 302*b*, that allow the pad 300 to be folded around the perimeter (relative to its longitudinal axis) of the play yard 200 when the play yard 200 is collapsed and to hinge with respect to each other, allowing the mattress pad 300 to correspond to the contour of the bassinet assembly floor 102 of the bassinet assembly 100. Accordingly, if the floor 102 of the bassinet assembly 100 is in the inclined position, one section 302*a*, 302*b* of the mattress pad 300 can hinge upwardly with respect to the other section 301*a*, 301*b*. Similarly, if the bassinet assembly floor 102 is in the flat position, the mattress pad 300 can lay flat along the length of the floor 102. In other various embodiments, the mattress pad may include two or more sections that are flexible or hinge with respect to each other. In another embodiment, the mattress pad may consist of one section only. In yet another embodiment, the mattress pad comprises two or more separate sections that are laid adjacent each other on the floor 102 of the bassinet assembly 100 or on the floor 202 of the play yard 200.

Zipper Lock

According to various embodiments of the invention, a zipper pull tab lock mechanism may be provided to secure the zipper pull tabs of the one or more zippers used to secure the bassinet assembly 100 within the play yard 200 or the inclinable flap 104 of the bassinet assembly 100 in an inclined position with respect to the floor 102 of the bassinet assembly 100.

FIG. 17 illustrates a perspective view of a zipper pull tab lock 400 according to one embodiment. In particular, the zipper pull tab lock 400 includes an outer sleeve 401 and an inner sleeve 451. The outer sleeve 401 defines a cavity 403, an opening 405 at a first end 406 of the cavity 403, and a release tab 408 disposed above the cavity 403. The release tab 408 has a free end 409 and a fixed end 410, and the fixed end 410 of the release tab 408 is integrally formed with the outer sleeve 401 adjacent the opening 405. The free end 409 of the release tab 408 is movable downwardly into the cavity 403, and the free end 409 and the fixed end 410 of the release tab 408 are aligned along a longitudinal axis 411 of the outer sleeve 401.

The inner sleeve 451 includes a lower surface 453, and the lower surface 453 defines an engaging tab 455 that includes a free end 456, a fixed end 457 integrally formed with the lower surface 453, a first protrusion 458, and a second protrusion 459. The free end 456 and the fixed end 457 of the engaging tab 455 are aligned along a longitudinal axis 460 of the inner sleeve 451. The first protrusion 458 is disposed adjacent the free end 456 of the engaging tab 455, and the second protrusion 459 is disposed inwardly of the free end 458 toward the fixed end 457 of the engaging tab 455. The first protrusion 458 and the second protrusion 459 extend upwardly from the lower surface 453 of the inner sleeve 451.

The inner sleeve 451 is slidably engageable within the opening 405 of the cavity 403 such that the first protrusion 458 on the free end 456 of the engaging tab 455 is disposed below the free end 409 of the release tab 408 of the outer sleeve 401. In addition, a longitudinal axis 460 of the inner sleeve 451 is coaxial with the longitudinal axis 411 of the outer sleeve 401 when the inner sleeve 451 is slidably engaged within the cavity 403 of the outer sleeve 401.

Furthermore, a stop 461 extends downwardly from the lower surface 453 of the inner sleeve 451, and the outer sleeve 401 includes a lower surface 414 that defines a hole 412. The stop 461 is engaged into the hole 412 when the inner sleeve 451 is slidably engaged in the cavity 403 of the outer sleeve 401 to prevent the inner sleeve 451 from being slidably disengaged from the outer sleeve 401. In an alternative embodiment (not shown), the lower surface 414 of the outer sleeve 401 defines a depressed portion into which the stop 461 may be engaged to prevent the inner sleeve 451 from being slidably disengaged from the cavity 403 of the outer sleeve 401.

A zipper pull tab 470 defining a hole 471 therethrough is slidably engageable within the opening 405 of the cavity 403 such that the second protrusion 459 engages the hole 471 of the zipper pull tab 470 to prevent removal of the zipper pull tab 470 from the cavity 403 of the outer sleeve 401. When the release tab 408 is urged downwardly into contact with the first protrusion 458, the free end 456 of the engaging tab 455 is moved downwardly and the second protrusion 459 is moved away from the hole 471 of the pull tab 470, allowing the pull tab 471 to be slidably disengaged from the opening 405 of the cavity 403.

The lower surface 414 of the outer sleeve 401 further defines an opening 413 through which the free end 456 of the engaging tab 455 moves when the release tab 408 is urged downwardly into contact with the first protrusion 458. In an alternative embodiment (not shown), the lower surface 414 of the outer sleeve 401 defines a depressed portion into which the free end 456 of the engaging tab 455 moves when the release tab 408 is urged downwardly into contact with the first protrusion 458.

The engaging tab 455 and release tab 408 described above allow for the zipper pull tab 470 to be removably engaged within the zipper pull tab lock 400. In a further embodiment, the zipper pull tab lock 400 provides for permanently securing a second zipper pull tab 480 within the outer sleeve 401 such that two zippers may be secured adjacent each other in an end-to-end relationship along the longitudinal axis 411 of the outer sleeve 401. In particular, the outer sleeve 401 further defines a second opening 415 at a second end 416 of the outer sleeve 401 that is opposite the first end 406 along the longitudinal axis 411 of the outer sleeve 401. In addition, an upwardly extending protrusion 422 is disposed on a lower surface 420 of the outer sleeve 401. The upwardly extending protrusion 422 is configured for engaging a hole 481 defined through the second zipper pull tab 480 such that when the second zipper pull tab 480 is slidably engaged through the second opening 415, the upwardly extending protrusion 422 is engaged through the hole 481 of the second zipper pull tab 480 to prevent the second zipper pull tab 480 from being disengaged from the outer sleeve 401. In one embodiment, an upper surface of the outer sleeve 401 is substantially solid above the upwardly extending protrusion 422 such that the upwardly extending protrusion 422 cannot be urged downwardly through the upper surface of the outer sleeve 401.

As shown in FIGS. 17 and 18, the upwardly extending protrusion 422 and the free end 409 of said release tab 408 are disposed opposite each other and adjacent a central vertical axis 490 through a medial portion 430 of the outer sleeve 401. The central vertical axis 490 is substantially perpendicular to the longitudinal axis 411 of the outer sleeve 401.

FIGS. 21-23, 24A, and 25A illustrate a zipper pull tab lock 500 according to another embodiment of the invention. The zipper pull tab lock 500 includes an outer housing 501 and two inner sleeves 551, 571.

The outer housing 501 includes an upper surface 503 that defines a first opening 505, a lower surface 507, a cavity defined between the upper surface 503 and the lower surface 507, a first end portion 509 that defines a second opening 510, and a second end portion 515 that defines a third opening 516. The first opening 505, the second opening 510, and the third opening 516 are in communication with the cavity. A vertical axis 511 of the outer housing 501 extends through the first opening 505, and a longitudinal axis 513 of the outer housing 501 extends through the second opening 510 and the third opening 516. The longitudinal axis 513 and the vertical axis 511 are substantially perpendicular to each other.

Inner sleeve 551 is slidably engageable within the cavity of the outer housing 501 through the second opening 510, and inner sleeve 571 is slidably engageable within the cavity of the outer housing 501 through the third opening 516. Each inner sleeve 551, 571 includes a lower surface 553 that defines an engaging tab 555, and the engaging tab 555 includes a free end 557, a fixed end 559 integrally formed with the lower surface 553, a first protrusion 560, and a second protrusion 561. The free end 557 and the fixed end 559 of the engaging tab 555 are aligned along a longitudinal axis 570 of the inner sleeve 551, the first protrusion 560 is disposed adjacent the free end 557 of the engaging tab 555, and the second protrusion 561 is disposed inwardly of the free end 557 toward the fixed end 559 of the engaging tab 555. The first protrusion 560 and the second protrusion 561 extend upwardly from the lower surface 553.

In addition, a stop 563 extends downwardly from the lower surface 553 of each inner sleeve 551, 571, and the lower surface 507 of the outer housing 501 defines two openings 512*a*, 512*b* that are in communication with the cavity. The stop 563 of each inner sleeve 551, 571 is engageable with the opening 512*a*, 512*b*, respectively, when the inner sleeves 551, 571 are slidably engaged in the outer housing 501 to prevent the inner sleeves 551, 571 from being slidably disengaged from the outer housing 501. In an alternative embodiment (not shown), the lower surface 507 of the outer housing 501 may define depressed portions that are in communication with the cavity that engage the stops 563 of the inner sleeves 551, 571.

As mentioned above, the inner sleeves 551, 571 are slidably engageable within the second opening 510 and the third opening 516, respectively, along the longitudinal axis 513 of the outer housing 501 such that the first protrusion 560 on the free end 557 of the engaging tab 555 is disposed below the first opening 505. In addition, the first zipper pull tab 470 is slidably engageable within the second opening 510 of the cavity such that the second protrusion 561 of inner sleeve 551 engages the hole 471 of the first zipper pull tab 470 to prevent removal of the first zipper pull tab 470 from the cavity of the outer housing 501. Similarly, the zipper pull tab 480 is slidably engageable within the third opening 516 of the cavity such that the second protrusion 561 of inner sleeve 571 engages the hole 481 of the second zipper pull tab 480 to prevent removal of the second zipper pull tab 480 from the cavity of the outer housing 501. When the first protrusions 560 of the inner sleeves 551, 571 are urged downwardly through the first opening 505, the free ends 557 of the engaging tabs 555 are moved downwardly and the second protrusions 561 are moved away from the holes 471, 481 of the zipper pull tabs 470, 480, respectively, allowing the zipper pull tabs 470, 480 to be slidably disengaged from the second opening 510 and the third opening 516 of the cavity.

In a particular embodiment, the lower surface 507 of the outer housing 501 defines at least one opening 514 through which the free ends 557 of the engaging tabs 555 of the inner sleeves 551, 571 can move when urged downwardly through the first opening 505. In an alternative embodiment (not shown), the lower surface 507 of the outer housing 501 may define a depressed portion in communication with the cavity into which the free ends 557 of the engaging tabs 555 of the inner sleeves 551, 571 can move.

As shown in FIGS. 21-23, 24A, and 25A, the zipper pull tab lock 500 also includes a button 580 that is disposed within the first opening 505, and the button is movable downwardly to engage the first protrusions 560 disposed on the free ends 557 of the engaging tabs 555 of the inner sleeves 551, 571. The first opening 505 and the button 580 shown in these figures are oval shaped.

In an alternative embodiment shown in FIGS. 24B and 25B, a first protrusion 660*a* is disposed on the engaging tab 655 of inner sleeve 651, and a first protrusion 660*b* is disposed on the engaging tab 655 of inner sleeve 671. The first protrusions 660*a*, 660*b* extend upwardly from the lower surface of inner sleeves 651, 671, respectively, and each have a half-spherical shape. The half-spherical shape of the first protrusion 660*a* on inner sleeve 651 is disposed adjacent the half-spherical shape of the first protrusion 660*b* on inner sleeve 671, forming a substantially whole spherical shape, when the inner sleeves 651, 671 are slidably engaged within the cavity of the outer housing 501. The first protrusions 660*a*, 660*b* extend upwardly through a substantially circular opening 605 defined in the upper surface 503 of the outer housing 501.

In an alternative embodiment (not shown), a tool is removably inserted into the first opening 505 to move the free end 557 of the engaging tab 555 downwardly.

In a further embodiment, the outer housing 501 of the zipper pull tab lock 500 defines slots 585 that extend along the sides 586 of the outer housing 501 between each end 509, 515 of the outer housing 501. The slots 585 can receive straps to secure the zipper pull tab lock 500 adjacent another object.

FIGS. 26 and 27 illustrate a zipper pull tab lock 700 according to yet another embodiment of the invention. The zipper pull tab lock 700 includes a housing 701, a lock member 751, and a compression spring 765. The housing 701 includes an upper housing member 703 and a lower housing member 705, and the upper 703 and lower housing members 705 form a channel 707 therebetween. The upper housing member 703 defines a first opening 709 through a medial portion thereof along a vertical axis 710 of the housing 701, and the upper housing member 703 and the lower housing member 705 define a second opening 711 at a first end 713 and a third opening 721 at a second end 720 thereof. The second 711 and third openings 721 are disposed along a longitudinal axis 715 of the housing 701. The longitudinal axis 715 and the vertical axis 710 are substantially perpendicular to each other. The lower housing member 705 also defines a depressed portion 717 disposed below the first opening 709 of the upper housing member 703 along the vertical axis 710. The first opening 709, the second opening 711, the third opening 721, and the depressed portion 717 are in communication with the channel 707.

The lock member 751 is disposed within the channel 707 along the vertical axis 710, and the lock member 751 includes an upper surface 753 that is accessible through the first opening 709. The lock member 751 also includes a lower surface 755 that is disposed adjacent to the depressed portion 717 and two integrated paws 757, 761 that are defined in side surfaces 759, 763 of the lock member 751. The side surfaces 759, 763 extend between the upper surface 753 and the lower surface 755. The integrated paws 757, 761 are about 180 degrees apart from each other, and each integrated paw 757, 761 is configured for engaging the hole 471, 481 defined through zipper pull tabs 470, 480.

The compression spring 765 is disposed intermediate the depressed portion 717 and the lower surface 755 of the lock member 751, and the compression spring biases the lock member 701 upwardly to maintain engagement of the integrated paws 757, 761 within the hole 471, 481 of respective zipper pull tabs 470, 480 when the zipper pull tabs 470, 480 are slidably engaged through the second opening 711 and third opening 721, respectively, along the longitudinal axis 715 of the housing 701. When the lock member 751 is moved downwardly, the integrated paws 757, 761 are disengaged from the holes 471, 481 of the zipper pull tabs 470, 480, respectively, allowing the zipper pull tabs 470, 480 to be slidably disengaged from the second opening 711 and the third opening 721, respectively, of the housing 701.

In the embodiment shown in FIGS. 26 and 27, the upper surface 753 of the lock member 751 extends through the first opening 709, and the lock member 751 is substantially cylindrical. However, in alternative embodiment (not shown), the upper surface of the lock member may not extend through the first opening (e.g., may be accessible through the first opening), and the lock member may have a different shape, such as rectangular or triangular.

CONCLUSION

Although this invention has been described in specific detail with reference to the disclosed embodiments, it will be understood that many variations and modifications may be effected within the spirit and scope of the invention as described in the appended claims.

The invention claimed is:

1. A bassinet assembly comprising:

a floor;

one or more side walls that extend upwardly from a perimeter of said floor and surround said floor; and one or more attachment members disposed on said one or more side walls and configured for securing said bassinet assembly to a play yard;

wherein each of said side walls has an upper perimeter, and each of said side walls comprises (1) a mesh portion that extends the full height of each of said side walls from said upper perimeter to said floor and (2) a substantially solid fabric wall portion that extends from said upper perimeter to an intermediate portion of said side wall, said intermediate portion being disposed between said upper perimeter and said floor, wherein at least a portion of said side wall between said intermediate portion and said floor of said bassinet assembly is mesh.

2. The bassinet assembly of claim 1, wherein said portion of said side wall between said intermediate portion and said floor of said bassinet assembly aligns with a mesh portion of one or more side walls of said play yard when said bassinet assembly is secured within said play yard.

3. The bassinet assembly of claim 1 wherein said mesh portion allows a child laying therein to breathe through said mesh portion.

4. The bassinet assembly of claim 1, wherein said one or more attachment members comprise one or more rows of zipper teeth disposed along said one or more side walls.

5. The bassinet assembly of claim 1, wherein said one or more attachment members comprises one or more buckles disposed on said one or more side walls.

6. The bassinet assembly of claim 1, wherein said solid fabric wall portion extends along the full length of said upper perimeter.

7. A play yard comprising:

a floor; and one or more side walls that extend upwardly from a perimeter of said floor and surround said floor, wherein each of said side walls has an upper perimeter, and each of said side walls comprises a mesh portion that extends the full height of each of said side walls from said upper perimeter to said floor and a substantially solid fabric wall portion that extends from said upper perimeter to an intermediate portion of said side wall along the full length of said upper perimeter, said intermediate portion being disposed between said upper perimeter and said floor, wherein at least a portion of said side wall between said intermediate portion and said floor of said play yard is mesh.

8. The play yard of claim 7 wherein said portion of said side wall between said intermediate portion and said floor of said play yard aligns with a mesh portion of one or more side walls of a bassinet assembly when said bassinet assembly is secured within said play yard.

9. The play yard of claim 8 wherein a child laying within the play yard and bassinet assembly can breathe through said mesh portion of said play yard that aligns with said mesh portion of said bassinet assembly.

* * * * *